US005360703A

United States Patent [19]

Chang et al.

[11] Patent Number: 5,360,703

[45] Date of Patent: * Nov. 1, 1994

[54] MULTICOLOR PHOTOGRAPHIC ELEMENTS EXHIBITING AN ENHANCED CHARACTERISTIC CURVE SHAPE

[75] Inventors: Elizabeth P. Chang, Webster; James A. Friday, Rochester, both of N.Y.

[73] Assignee: Eastman Kodak Company, Rochester, N.Y.

[ * ] Notice: The portion of the term of this patent subsequent to May 24, 2011 has been disclaimed.

[21] Appl. No.: 10,689

[22] Filed: Jan. 28, 1993

[51] Int. Cl.[5] ..... G03C 1/46

[52] U.S. Cl. ..... 430/506; 430/503; 430/509; 430/567

[58] Field of Search ..... 430/503, 506, 509, 567

[56] References Cited

U.S. PATENT DOCUMENTS

| | | | |
|---|---|---|---|
| 3,843,369 | 10/1974 | Kumal et al. | 96/74 |
| 4,433,048 | 2/1984 | Solberg et al. | 430/503 |
| 4,439,520 | 3/1984 | Kofron et al. | 430/434 |
| 4,952,485 | 8/1990 | Shibahara et al. | 430/506 |

FOREIGN PATENT DOCUMENTS

| | | |
|---|---|---|
| 0136603A3 | 10/1985 | European Pat. Off. . |
| 0326853A1 | 9/1989 | European Pat. Off. . |
| 0426194A1 | 8/1991 | European Pat. Off. . |

OTHER PUBLICATIONS

Buhr, et al. *Research Disclosure,* vol. 253, Item 25330, May 1985.

*Primary Examiner*—Charles L. Bowers, Jr.
*Assistant Examiner*—Geraldine Letscher
*Attorney, Agent, or Firm*—Carl O. Thomas

[57] ABSTRACT

Multicolor photographic elements are disclosed containing at least three dye image forming layer units. An enhancement of the speed-granularity relationship of a dye image is obtained when the corresponding dye image forming layer unit contains at least three superimposed silver bromoiodide emulsion layers. The emulsion layer nearest the support containing an average iodide content of up to 60 percent the iodide content of the next overlying of the emulsion layers. The three emulsion layers each differ in speed from the next adjacent of the emulsion layers, with the fastest of the emulsion layers being located nearest the source of exposing radiation and being at least one half stop faster than the next adjacent layer and the slowest of the emulsion layers being located farthest from the source of exposing radiation and being at least one half stop slower than the next adjacent layer. The three emulsions layers are each tabular grain emulsion layers with tabularities of greater than 25. At least the two emulsion layers located nearest the sourch of exposing radiation exhibiting stimulated fluorescent emissions indicative of relatively uniform iodide distribution within the grains.

12 Claims, 2 Drawing Sheets

MULTICOLOR PHOTOGRAPHIC ELEMENTS EXHIBITING AN ENHANCED CHARACTERISTIC CURVE SHAPE

FIELD OF THE INVENTION

The invention relates to silver halide photography. More specifically, the invention relates to silver halide photographic elements capable of producing multicolor dye images.

BACKGROUND

Figure 1:
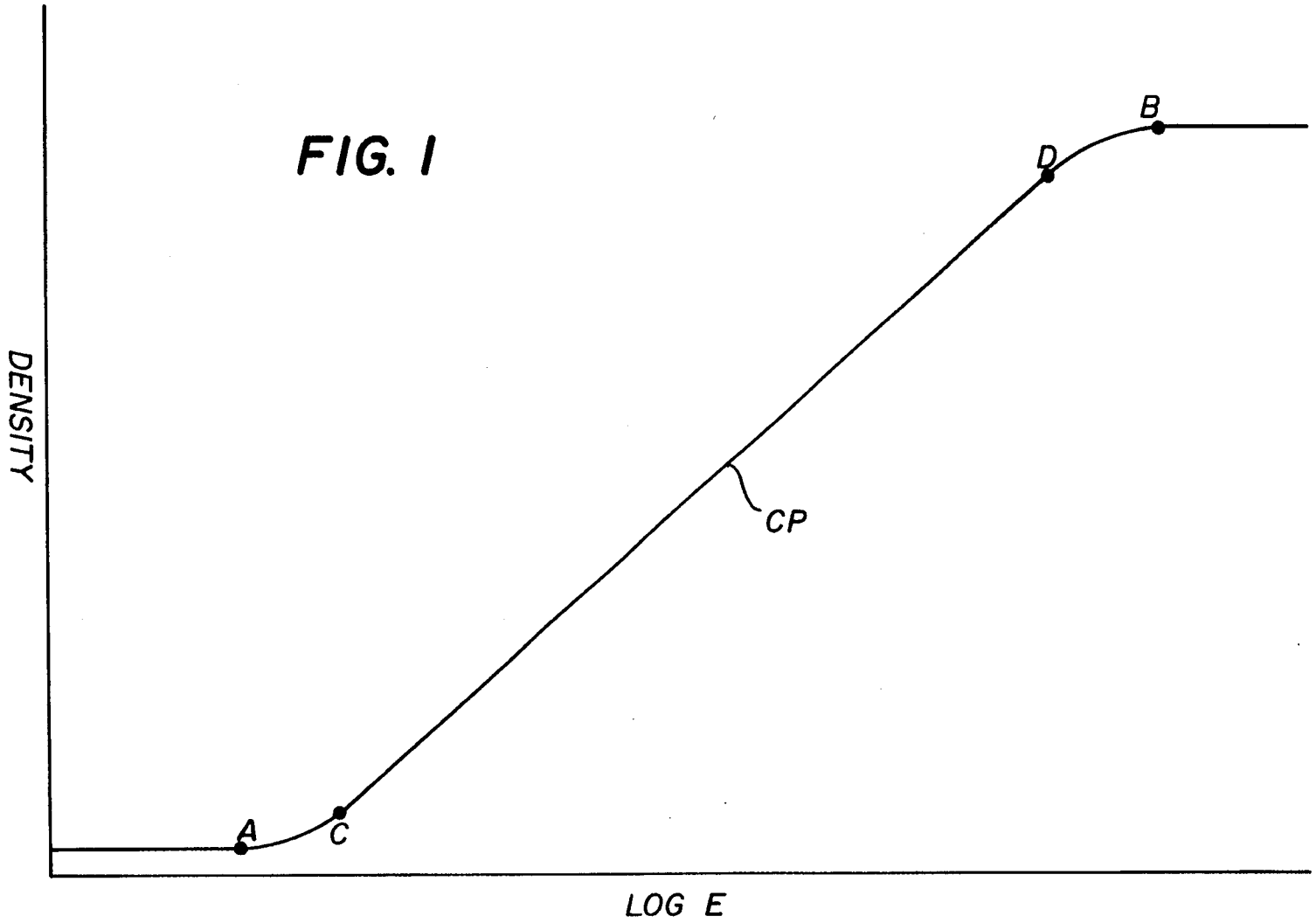
FIG. 1 is a schematic diagram of an ideal characteristic profile obtained by plotting optical density versus log exposure in lux-seconds.

In constructing a multicolor silver halide photographic element primary reliance for analysis of performance is still placed on characteristic profiles of the type first suggested by Hurter and Driffield in the nineteenth century. An ideal characteristic profile is shown in FIG. 1, wherein optical density (hereinafter referred to as density) is plotted against log exposure. The characteristic profile CP produced by varied levels of exposure of a photographic element followed by processing and processing provides a valuable insight into the photographic performance to be expected in imaging. Exposures less than received at point A, just to the left of the toe of the characteristic profile, do not give rise to any increase in density. The displacement of the characteristic profile above zero density is referred to as minimum density (Dmin) or fog. Useful imaging occurs at exposures between points A and B. Exposures higher than those at point B, lying just to the right of the shoulder of the characteristic profile, produce no further increase in density. Point B lies at the highest attainable density, referred to as maximum density (Dmax). For the purpose of comparing photographic element speeds a reference point such as C is selected on the characteristic profile, typically at about 0.01 density unit above fog. The slope of the characteristic profile ($\Delta$density/$\Delta$log E), referred to as contrast or $\gamma$, usually measured over some segment of the curve CP bridging mid-scale density, also provides valuable information on imaging characteristics. Toe contrast, measured in the A to C toe region of the characteristic profile, and shoulder contrast, measured in the D to B shoulder region of the characteristic profile, also provide useful measures of imaging properties. The displacement along the exposure scale of points A and B determines the exposure latitude of the film. The longer the exposure latitude the lower the risk image information being lost through over or under exposure during imaging. The accepted units of exposure (E) are lux (previously, meter-candle)-seconds. Each 0.3 increase in log exposure doubles the exposure and is referred to by photographers as a "stop". A half stop is 0.15 log E.

In constructing a multicolor photographic element the aim is usually to construct an element capable of producing at least three distinct characteristic profiles, indicative of the a yellow dye characteristic profile produced by blue light exposure, a magenta dye characteristic profile produced by green light exposure and a cyan dye characteristic profile produced by red light exposure. The aim is usually to produce yellow, magenta and cyan profiles that are as nearly superimposed as possible. This is facilitated by characteristic profiles for each of the color records that are as nearly linear as possible over the intended exposure range. For example, in characteristic profile CP the linear portion of the characteristic profile between points C and D is ideal for color imaging, since a linear profile within an acceptable working exposure range facilitates superposition of yellow, magenta and cyan profiles and maintenance of an accurate color balance at varied levels of exposure.

Although the image dye characteristic profiles of a multicolor photographic element are useful in assessing its imaging qualities, one important image property that requires separate inquiry is image noise—i.e., granularity. It is generally recognized that photographic speed increases with increasing silver halide grain sizes and that image granularity also increases with silver halide grain sizes. The object in constructing multicolor photographic elements is usually to satisfy imaging application speed requirements while providing images of lowest attainable granularity.

PRIOR ART

Kofron et al U.S. Pat. No. 4,439,520 ushered in the modern era of high performance multicolor photographic elements. A variety of multicolor photographic element formats are taught with a recognition that their photographic performance can be enhanced by the incorporation of at least one high aspect ratio tabular grain silver halide emulsion layer, where "high aspect ratio tabular grain emulsion" is defined as an emulsion in greater than 50 percent of the total grain projected area is accounted for by tabular grains having a thickness (t) of less than 0.3 micrometer ($\mu$m), an equivalent circular diameter (ECD) of at least 0.6 $\mu$m, and an average aspect ratio (ECD/t) of greater than 8. Kofron et al suggested that for some imaging applications, such as image transfer or blue record formation, tabular grain thickness could be relaxed to 0.5 $\mu$m, but these emulsions are outside the "high aspect ratio tabular grain emulsion" definition. Kofron et al provides numerous examples of dividing one or more the blue, green or red recording layer units into fast and slow emulsion layers. Kofron et al demonstrates that dye images exhibiting improved speed-granularity relationships can be realized employing high aspect ratio tabular grain emulsions.

Before the teachings of Kofron et al raised the speed-granularity performance of multicolor photography to the modern level, a number of different approaches for reducing granularity were discussed in the art. Kumal et al U.S. Pat. No. 3,843,369 illustrates an approach in which a dye image forming layer unit was divided into three separate emulsion layers of differing speed with the highest speed emulsion layer being located nearest the source of exposing radiation and the slowest speed emulsion being positioned nearest the support. Kumal et al contains no disclosure of tabular grain emulsions. Since iodide profiles within grains are not mentioned, it can be presumed that iodide is uniformly distributed within the grains, and it certain that Kumal et al attributed no importance to the iodide profile. Finally, Kumal et al in every film having three layers forming a single color forming layer unit located the lowest iodide in the overlying intermediate speed emulsion layer, with no layer containing more iodide than the layer within dye image forming located nearest the support.

RELATED PATENT APPLICATION

Chang et al U.S. Serial No. 870,000, filed Apr. 16, 1992, titled MULTICOLOR PHOTOGRAPHIC ELEMENTS EXHIBITING AN ENHANCED SPEED GRANULARITY RELATIONSHIP, commonly assigned, now allowed discloses multicolor photographic elements containing at least three dye image forming layer units. An enhancement of the speed-granularity relationship of a dye image is obtained when the corresponding dye image forming layer unit contains at least three superimposed emulsion layers. The two emulsion layers farther from the support contain silver bromoiodide emulsions, with the emulsion layer nearest the support containing a silver bromide or bromoiodide emulsion of up to 60 percent the iodide as a proportion of silver of the next overlying of the emulsion layers. The three emulsion layers each differ in speed from the next adjacent of the emulsion layers, with the fastest of the emulsion layers being located nearest the source of exposing radiation and being at least one half stop faster than the next adjacent layer and the slowest of the emulsion layers being located farthest from the source of exposing radiation and being at least one stop slower than the next adjacent layer. The three emulsions layers are each tabular grain emulsion layers with tabularities of greater than 25. At least the two emulsion layers nearest the source of exposing radiation tabular grains that contain a speed enhancing locally increased iodide content.

SUMMARY OF THE INVENTION

In one aspect this invention is directed to a multicolor photographic element capable of satisfying a selected characteristic profile with reduced granularity comprised of a support and at least three dye image forming layer units each containing an image dye or dye precursor capable of forming a dye image of a different hue.

The invention is characterized in that at least one of the dye image forming layer units capable of forming a visible dye image contains at least three superimposed radiation sensitive emulsion layers in which (a) a first emulsion layer located farthest from the support of the three emulsion layers contains silver bromoiodide grains of from 1 to 20 mole percent iodide, based on silver, (b) a second emulsion layer at least one half stop slower in speed than the first emulsion layer is located between the first emulsion layer and the support and contains silver bromoiodide grains of from 1 to 20 mole percent iodide, based on silver, and (c) a third emulsion layer at least one half stop slower in speed than the second emulsion layer is located between the second emulsion layer and the support and contains silver bromoiodide grains having an average iodide content that is up to 60 percent the average iodide content of the second emulsion layer. Greater than 50 percent of the total projected area of the grains of each of the first, second and third emulsion layers is accounted for by tabular grains having a thickness of less than 0.3 μm and an average tabularity of greater than 25, tabularity (T) being defined as $$T=ECD/t^2$$

where

ECD is the average equivalent circular diameter of the tabular grains in μm and t is the average thickness in μm of the tabular grains.

Tabular grains of at least the first and second of the emulsion layers when exposed to 325 nm electromagnetic radiation at 6° K. exhibit a stimulated fluorescent emission at 575 nm that is less than one third the intensity of an identically stimulated fluorescent emission maximum within the wavelength range of from 490 to 560 nm.

The invention makes possible multicolor photographic elements that efficiently produce dye images of low granularity over the exposure latitudes customarily expected of color negative films and beyond. The characteristic profiles produced by dye image forming layer units constructed according to the invention more nearly approach ideal imaging requirements. In particular, these dye image forming layer units provide significant improvements in shoulder contrast.

DESCRIPTION OF PREFERRED EMBODIMENTS

The present invention is directed to an improvement in multicolor photographic elements of the type that contain at least three superimposed dye image forming layer units intended to record a different portion of the electromagnetic spectrum coated on a support.

A simple illustration of a multicolor photographic element of this type is as follows:

| |
|---|
| Yellow Dye Image Forming Blue Recording Layer Unit (Y-B) |
| Magenta Dye Image Forming Green Recording Layer Unit (M-G) |
| Cyan Dye Image Forming Red Recording Layer Unit (C-R) |
| Support (S) |

For simplicity in this and subsequent layer arrangement descriptions conventional details, such as protective overcoat layers, oxidized developing agent scavenger interlayers between adjacent layer units, yellow filter interlayers to protect minus blue (green or red) recording layer units from blue exposure, subbing layers, and the like, all well within the routine selection competency of the art, are not explicitly described, but are understood to be present in any convenient conventional form.

In addition to the above arrangement, Y-B/M-G/C-R/S, there are five possible additional arrangements: Y-B/C-R/M-G/S, C-R/Y-B/M-G/S, M-G/Y-B/C-R/S, M-G/C-R/Y-B/S and C-R/M-G/Y-B/S, all within the contemplation of this invention. These six layer unit arrangements are all capable of reproducing (or at least approximating) natural (actual subject) colors. Note that in all the natural color layer unit arrangements within each layer unit the image dye absorbs in approximately the same spectral region recorded by exposure. There are in addition an unlimited number of so-called "false color" layer unit combinations in which one or more of the dye image forming layer units contain an image dye (or dye precursor) that does not absorb light in approximately same spectral region as is recorded. For example, false color layer unit combinations are often incorporated in aerial mapping films, where the wavelengths of primary interest being recorded often extend well into the infrared and visible image dyes of arbitrarily selected hues are used to display infrared (IR) images.

Although multicolor photographic elements usually contain only blue, green and red recording dye image forming layer units, dye image forming layer units that record outside the visible spectrum can also be included to satisfy specific imaging requirements. A simple specific illustration is provided by the following layer unit combination:

| |
|---|
| Yellow Dye Image Forming Blue Recording Layer Unit (Y-B) |
| Magenta Dye Image Forming Green Recording Layer Unit (M-G) |
| Cyan Dye Image Forming Red Recording Layer Unit (C-R) |
| IR Dye Image Forming IR Recording Layer Unit (IR-IR) |
| Support (S) |

A film of this construction can be employed, for example, to provide invisible information in the IR-IR layer unit, such as frame, scene, date and/or time information that can be read out upon scanning with a solid-state infrared laser.

In the foregoing multicolor photographic elements each of the dye image forming layer units records in a different portion of the electromagnetic spectrum. More than three layer units can be present in a multicolor photographic element as a result of dividing a dye image forming layer unit intended to record in one region of the spectrum into two noncontiguous layer units, usually two noncontiguous layer units differing in speed. The following is a specific example of a multicolor photographic element of this type:

| |
|---|
| Yellow Dye Image Forming Blue Recording Layer Unit (Y-B) |
| Faster Cyan Dye Image Forming Red Recording Layer Unit (FC-R) |
| Magenta Dye Image Forming Green Recording Layer Unit (M-G) |
| Slower Cyan Dye Image Forming Red Recording Layer Unit (SC-R) |
| Support (S) |

Instead of a multicolor photographic element of the layer unit sequence Y-B/FC-R/M-G/SC-R/S above, an almost equally attractive layer unit sequence can be obtained by changing the green and red recording layer units to arrive at the following sequence Y-B/FM-G/C-R/SM-G/S. In each of these arrangements there are four distinct dye image forming layer units. When a layer unit such as IR-IR above is added, five separate layer units can be present.

As is generally recognized in the art, any one, any combination or all of the various dye image forming layer units can contain more than one silver halide emulsion layer. When more than one silver halide emulsion layer is present within a dye image forming layer unit, it is preferred that two or three silver halide emulsion layers be present differing in speed. Additionally, it is preferred that the faster or fastest emulsion layer present within the layer unit be located farther or farthest from the support and that the slower or slowest emulsion layer unit be located nearer or nearest to the support.

It has been discovered that improved photographic performance can be realized in any of the multicolor photographic element formats described above when at least one of the dye image forming layer units capable of forming a viewable dye image contains a high performance combination of at least three emulsion layers satisfying specific selection criteria hereinafter described. In one specifically preferred form of the invention a multicolor photographic element containing one yellow, one magenta and one cyan dye image forming layer unit is selected to satisfy the high performance combination requirements of the invention is contemplated. When only one high performance combination layer unit satisfying the requirements of the invention is present, it can be a magenta, cyan or yellow dye image forming layer unit in that order of preference, since the eye extracts the highest proportion of image information from the green portion of the spectrum, somewhat less image information from the red portion of the spectrum, and only about 10 percent of total image information from the blue portion of the spectrum. Following the order of preference further, when only two high performance combination dye image forming layer units are present, they are preferably magenta and cyan dye image forming layer units.

However, this order of preference need not be followed in every instance, since other considerations can lead to alternate choices. For example, the high performance combination layer units of the invention are most advantageously applied to multicolor photographic element formats in which the high performance combination layer unit is the sole layer unit responsible for producing a dye image of that hue. For example, in the format Y-B/FC-R/M-G/SC-R/S described above the first preference is for the M-G dye image forming layer unit alone or both the Y-B and M-G dye image forming layer units to be high performance combinations. Similarly, in the format Y-B/FM-G/C-R/SM-G/S described above the first preference is for the C-R dye image forming layer unit alone or both the Y-B and C-R dye image forming layer units to be high performance combinations.

In considering the preferences stated above there is another type of layer unit arrangement must be considered, if only to avoid confusion with the Y-B/FC-R/M-G/SC-R/S and Y-B/FM-G/C-R/SM-G/S type of layer unit arrangements discussed above. The following are typical of layer unit arrangements of this type:

| |
|---|
| Yellow Dye Image Forming Blue Recording Layer Unit (Y-B) |
| Fast Skim Cyan Dye Image Forming Red Recording Layer Unit (FC-R, <0.1 Ag) |
| Magenta Dye Image Forming Green Recording Layer Unit (M-G) |
| Cyan Dye Image Forming Red Recording Layer Unit (C-R, >0.9 Ag) |
| Support (S) |
| and |
| Yellow Dye Image Forming Blue Recording Layer Unit (Y-B) |
| Fast Skim Magenta Dye Image Forming Green Recording Layer Unit (FM-G, <0.1 Ag) |
| Cyan Dye Image Forming Red Recording Layer Unit (C-R) |
| Magenta Dye Image Forming Green Recording Layer Unit (M-6 >0.9 Ag) |

-continued

| Support (S) |
|---|

The Y-B/FC-R, <0.1 Ag/M-G/C-R, >0.9 Ag/S and Y-B/FM-G, <0.1 Ag/C-R/M-G, >0.9 Ag/S layer unit arrangements can best be understood as being variants of the Y-B/M-G/C-R/S and Y-B/C-R/M-G/S layer unit arrangements described above in which a small portion (typically accounting for less than 10% and optimally less than 5% of the total silver used to form the red or green record) has been split out and relocated as a separate dye image forming layer unit more favorably located for receiving exposing radiation. The advantage of this arrangement is that a significant increase in threshold imaging speed can be realized with minimal impact on overall granularity of the red or green record. The increase in threshold speed can stem entirely from the more favorable location of the skim layer unit, or the skim layer unit can additionally employ an inherently faster emulsion than is present in the underlying layer unit forming a part of the same color record. Because of the limited proportion of total silver forming the color record present in the skim layer unit, the underlying layer unit completing the color record is still primarily for the color record density scale during exposure. The C-R, >0.9Ag and M-G, >0.9Ag layer units are preferably constructed essentially similarly to the C-R and M-G layer units described above and can each be high performance combination type layer units satisfying the requirements of this invention. They each can be sole high performance layer unit present in a multicolor photographic element or they can be present with one, two or more additional high performance layer units.

The high performance layer units satisfying the requirements of the invention contain at least three tabular grain emulsion layers coated in the following superimposed arrangement:

| Fastest Emulsion Layer (F-EmL) |
|---|
| Mid Emulsion Layer (M-EmL) |
| Slowest Eulsion Layer (S-EmL) |

The slowest of the three emulsion layers S-EmL is coated nearest the support. In this arrangement the fastest of the three emulsion layers F-EmL is coated farthest from the support and, in the most common orientation for exposure, is positioned to receive exposing radiation prior to the other two emulsion layers. Both F-EmL and M-EmL contain silver bromoiodide tabular grains containing from about 1 to 20 mole percent iodide, based on silver. Further improved performance is realized when M-EmL contains silver bromoiodide grains with an average iodide content of up to 60 percent that of F-EmL. S-EmL contains silver bromoiodide grains with an average iodide content of up to 60 percent that of M-EmL. M-EmL is at least one half stop (0.15 log E) slower in speed than F-EmL, and S-EmL is at least one half stop slower in speed than M-EmL. Although a variety of density levels are used in the art for comparing speed, for the sake of definiteness, the speed comparisons herein discussed are measured at a density of 0.02 above fog.

F-EmL, M-EmL and S-EmL function as an interactive imaging unit capable of producing photographic dye images of highly desirable characteristic profiles and exhibiting a highly favorable relationship of photographic sensitivity to dye image granularity. The imaging advantages produced by the high performance dye image forming layer units of the multicolor photographic elements of this invention are the unexpected product of grain tabularity, both overall and grain site specific iodide content selections, relative speed selections, and layer order arrangement.

Each of F-EmL, M-EmL and S-EmL contain tabular grain emulsions. Specifically contemplated tabular grain emulsions are those in which greater than 50 percent of the total projected area of the emulsion grains are accounted for by tabular grains having a thickness of less than 0.3 μm and an average tabularity (T) of greater than 25 (preferably greater than 100), where the term "tabularity" is employed in its art recognized usage as $$=ECD/t^2$$

where

ECD is the average equivalent circular diameter of the tabular grains in μm and t is the average thickness of μm of the tabular grains.

The average useful ECD of photographic emulsions can range up to about 10 μm, although in practice emulsion ECD's seldom exceed about 4 μm. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 μm) tabular grains. To achieve the lowest levels of granularity it is preferred to that aim tabular grain projected areas be satisfied with ultrathin (t<0.06 μm) tabular grains. Tabular grain thicknesses typically range down to about 0.02 μm. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 μm.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

In each of S-EmL, M-EmL and F-EmL the tabular grain emulsion can be the only emulsion present or the tabular grain emulsion can be blended with other emulsions. Blends of tabular grain emulsions satisfying the tabularity and size criteria above are specifically contemplated within each emulsion layer. Blending of tabular grain emulsions can be undertaken, for example, to extend exposure latitude. It is generally recognized in the art that two relatively monodisperse emulsions that are each optimally sensitized can be more photographically efficient than an optimally sensitized relatively polydisperse emulsion. Tabular grain emulsions having coefficients of variation (COV's) of less than 30 percent and preferably less than 20 percent are preferred, COV is defined as 100 times the standard deviation of grain diameter divided by average grain diameter. It is common in the art to add small amounts of non-imaging silver halide grain populations to emulsion layers to modify photographic performance. For example, it is common practice to blend in small proportions of Lippmann emulsions, which typically have ECD's of less than about 0.07 μm, to modify the characteristic profile of a multicolor photographic element.

To improve the sharpness of dye images formed by underlying emulsion layers, particularly in underlying dye image forming layer units, it is preferred that the tabular grains in any one or combination (optimally all) of S-EmL, M-EmL and F-EmL account for greater than 97 percent of the total grain population within the emulsion layer of a size capable of significantly scattering light. For example, grains having an ECD of less than about 0.2 μm do not scatter minus blue (green or red) light to any significant degree. Similarly grains having an ECD of less than 0.1 μm do not scatter blue light to a significant degree. Thus, choosing one or more of S-EmL, M-EmL or F-EmL such that tabular grains are present accounting for greater than 97 percent of the total projected area of grains having an ECD of at least 0.2 (and optimally 0.1) μm allows exceptionally sharp images to be formed in one or more underlying dye image forming layer units of the multicolor photographic elements of the invention.

It is generally recognized in the art that the incorporation of iodide in concentrations of as low as 0.1 mole percent, based on silver, into grain silver bromide crystal lattice structures significantly enhances photographic efficiency. Hence the most desirable speed-granularity relationships have been realized with silver bromoiodide emulsions. The saturation level of silver iodide within a silver bromide crystal lattice varies somewhat depending upon the temperature and/or pressure of precipitation, but is typically stated to be about 40 mole percent, based on total silver. In practice iodide levels seldom exceed about 20 mole percent iodide, based on total silver.

In addition to incorporating iodide within the tabular grain emulsion layers to increase their imaging efficiency the present invention further contemplates a relatively uniform distribution of iodide within the tabular grains of F-EmL and M-EmL and, preferably, all of the tabular grain emulsion layers. This simplifies emulsion preparation by allowing iodide ion in a uniform ratio to bromide ion to be introduced into the emulsion during its preparation. The iodide distribution in S-EmL can be either uniform or non-uniform. Non-uniform iodide distributions of the type disclosed by Solberg et al U.S. Pat. No. 4,433,048, here incorporated by reference, are specifically contemplated for S-EmL.

One way of assessing the uniformity of iodide distribution with tabular silver bromoiodide grains is to examine their stimulated fluorescent emission profiles. Tabular grains silver bromoiodide emulsions satisfying the iodide distribution requirements of this invention are those that, when exposed to 325 nm electromagnetic radiation at 6° K., exhibit a stimulated emission at 575 nm that is less than one third (preferably less than 25 percent and optimally less than 20 percent) the intensity of peak emission that occurs within the wavelength range of from 490 to 560 nm. This stimulated emission characteristic is evidence of relative iodide uniformity. As herein employed the term "relative iodide uniformity" is used to designate an absence of distinguishable phases differing in iodide content. In the simplest imaginable form the grains exhibit exactly the same iodide concentrations throughout. However, it is additionally recognized that grains without distinguishable iodide phases can be produced when iodide ion concentrations introduced during precipitation are ramped (i.e., increased or decreased over an a significant addition interval) in a controlled manner from one concentration level to another. The term "run-iodide" is commonly used to indicate uniform and ramped iodide additions. When iodide ion concentrations during emulsion precipitation are abruptly altered, typically by dumping a quantity of iodide ion in the reaction vessel, the tabular grains produced exhibit distinguishable iodide phases. When stimulated to fluoresce, rather than exhibiting a single emission maximum the emission spectra typically a composite of emissions at differing wavelengths is observed. This can be seen in dual peak emission spectra and or in a spectrally spread emission profile, where emission at one wavelength forms one shoulder of the overall emission profile.

When a tabular silver bromoiodide grain containing uniform iodide or an iodide concentration that is locally increased at a lateral location by a run-iodide approach is cooled to $<10°$ K. (6° K. being herein selected for specific comparisons) and stimulated with 325 nm wavelength electromagnetic radiation (e.g., with a helium cadmium laser), a single stimulated emission peak is observed in the wavelength range of from 490 to 560 nm, with emission at 575 nm, here selected as a spectrally displaced sampling location, being less than one third that observed at the peak . While the exact wavelength of maximum emission varies somewhat with varied iodide levels, the shape of the emission curves are quite similar. This suggests that in forming the crystal lattice of tabular grains by the run-iodide approach iodide ions have been accommodated within the silver bromide crystal lattice structure.

On the other hand, when silver bromoiodide grains are formed by the dump-iodide approach as described above, stimulation as described above at 325 nm can result, depending on iodide content, in a second distinguishable wavelength emission mode. Generally dump iodide in an amount sufficient to account for at least 1 mole percent iodide, based on total silver in the tabular grain, is required to produce an emission intensity at 575 nm that is at least one third the emission intensity maximum in the wavelength range of from 490 to 560 nm based on identical stimulations to 325 nm radiation. In other words at this level of dump-iodide a discernable longer wavelength shoulder is in evidence on the stimulated emission profile of the silver bromoiodide tabular grains. With dump-iodide levels of 3.5 percent or more, based on overall tabular grain silver, a second stimulated emission peak is present at or near 575 nm so that at 575 the intensity of emission is at least 90 percent of (and in most instances exceeds) the intensity of the emission peak in the wavelength range of from 490 to 560 nm.

It has been observed quite unexpectedly that a distinct performance advantage can be realized by limiting the overall average iodide content of S-EmL to 60 percent or less (preferably 40 to 60 percent) of the average iodide content of M-EmL. The iodide content of F-EmL and M-EmL are both maintained within the range of from 1 to 20 mole percent. A further improvement in performance can be realized by limiting the overall average iodide content of M-EmL to 60 percent or less (preferably 40 to 60 percent of the average iodide content of F-EmL.

While the role of iodide in the superior photographic properties of the high performance dye image forming layer unit containing F-EmL, M-EmL and S-EmL is too complex to have been a priori predicted, involving both exposure and development effects, the advantages can be at least partially explained by recognizing that F-EmL, M-EmL and S-EmL together form an interactive imaging unit, each interacting with and modifying the performance of the other. F-EmL, M-EmL and S-EmL are coated as adjacent layers to permit iodide ion migration between the layers to occur during processing. The adjacent layers are preferably contiguously coated one over the other without any intervening interlayer, although any interlayer that is iodide ion permeable during processing can be tolerated. Since F-EmL, M-EmL and S-EmL together produce a single dye image in the layer unit in which they are contained, there is no imaging requirement to place oxidized developing agent scavenger containing interlayers between the adjacent layers.

Notwithstanding the various tabularity, iodide content, and layer order selections described above, achieving the enhanced performance advantages contemplated further requires a proper ordering of the relative speeds of the F-EmL, M-EmL and S-EmL emulsion layers. M-EmL exhibits a speed that is at least one half stop (0.15 log E) slower than that of F-EmL. Further, S-EmL exhibits a speed that is at least one half stop slower than that of M-EmL. It is preferred that M-EmL exhibit a speed that is in the range of from 0.15 log E to 0.8 log E slower than that of F-EmL, optimally from 0.3 log E to 0.6 log E (1 to 2 stops) slower. It is preferred that S-EmL exhibit a speed that is in the range of from 0.15 log E to 1.30 log E, optimally 0.30 log E to 0.9 log E (1 to 3 stops), slower than that of M-EmL.

The specific choice of speed differences between the adjacent layers in excess of the required minimum differences will in most instances be determined by the intended overall exposure latitude of the multicolor photographic element. A minimum acceptable exposure latitude of a multicolor photographic element is that it be capable of in the same exposure of accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is in practice preferred to allow a small margin of error in exposure level selection by the photographer.

As previously discussed, in multicolor photography not only overall exposure latitude, but also the linearity of the characteristic profile within the working exposure range is also important for maintaining color balance. The linearity of the characteristic profile can be quantitatively expressed in terms of the variance of contrast (the slope of the characteristic profile). It is preferred that at least the high performance layer units satisfying the requirements of the invention and, most preferably, each of the layer units of the multicolor photographic element, exhibit a variance of contrast of less than 10 percent (optimally less than 5 percent) over an exposure range of at least 7 stops (2.1 log E).

The high performance layer unit construction described above can be used to form (a) only one, (b) any two, (c) any three or (d) more of the dye image forming layer units of a multicolor photographic element. Each or any combination of the Y-B, M-G and C-R dye image forming layer units of the multicolor photographic elements of the invention can take any of the forms described above.

However, in selecting a yellow dye image forming blue recording layer unit for incorporation in a multicolor photographic element satisfying the requirements Of this invention some selection adjustments are recognized to be feasible. The most fundamental differences affecting blue and minus blue recording layer unit selections can be traced to sunlight itself, which exhibits uniform energy levels throughout the visible spectrum. Since there is a spectral balance in energy levels, there is a deficiency of blue photons in sunlight, since shorter wavelength photons contain higher energy levels than shorter wavelength photons. Thus, if a multicolor photographic element is constructed with high performance Y-B and M-G layer units of identical grain content, each optimally sensitized, the photographic speed of the blue record is slightly, but significantly less than that of the green record. Since the eye is much less sensitive to the blue record than the green record, a common solution is to pay an increased granularity penalty to increase the speed of the blue record. The chromatically balances the photographic image at the expense of the quality of the blue record. Kofron et al U.S. Pat. No. 4,439,520 has suggested relaxing the $<0.3$ $\mu$m tabular grain thickness selection criterion discussed above to $<0.5$ $\mu$m to record blue light. By increasing the thickness of the tabular grains the native absorption capability of silver bromoiodide is utilized to increase blue light absorption. It is also a conventional practice to forego the advantages of tabular grains in the Y-B dye image forming layer unit, particularly in the faster or fastest emulsion layer, by substituting nontabular grains, which present a larger average silver volume per grain and thereby more readily achieve the absorption of blue light.

It is further recognized that the native blue absorption capability of silver bromoiodide is increased by increasing its iodide content. Thus, it is specifically contemplated to fabricate multicolor photographic elements satisfying the requirements of this invention in which the iodide content of the Y-B layer unit, particularly the F-EmL emulsion layer, contains a higher iodide content than the corresponding emulsion layers of the remaining dye image forming layer units. Thus, for example, whereas the minus blue recording (M-G and C-R) layer units are typically contemplated to exhibit an iodide concentration in the 1 to 10 mole percent range and relatively seldom in excess of 15 mole percent, the Y-B layer unit used in combination with these minus blue recording layer units can usefully have iodide concentrations in the 10 to 20 mole percent range or even higher to boost blue speed. The advantage of boosting iodide content to increase blue speed is that this, unlike reducing tabularity, does not inherently increase image granularity.

Tabular grain emulsions suitable for fabrication of F-EmL, M-EmL and S-EmL can be selected from among a variety of conventional teachings, such as those of the following teachings:

T-1 *Research Disclosure*, Vol. 225, January 1983, Item 22534, (*Research Disclosure* is published by Kenneth Mason Publications, Ltd., Emsworth, Hampshire P010 7DD, England);
T-2 Kofron et al U.S. Pat. No. 4,439,520;
T-3 Wilgus et al U.S. Pat. No. 4,434,226;
T-4 Maskasky U.S. Pat. No. 4,435,501;
T-5 Maskasky U.S. Pat. No. 4,643,966;
T-6 Yamada et al U.S. Pat. No. 4,647,528;
T-7 Sugimoto et al U.S. Pat. No. 4,665,012;
T-8 Daubendiek et al U.S. Pat. No. 4,672,027;
T-9 Yamada et al U.S. Pat. No. 4,678,745;
T-10 Daubendiek et al U.S. Pat. No. 4,693,964;
T-11 Maskasky U.S. Pat. No. 4,713,320;
T-12 Nottorf U.S. Pat. No. 4,722,886;
T-13 Sugimoto U.S. Pat. No. 4,755,456;
T-14 Goda U.S. Pat. No. 4,775,617;
T-15 Saitou et al U.S. Pat. No. 4,797,354;
T-16 Ellis U.S. Pat. No. 4,801,522;
T-17 Ikeda et al U.S. Pat. No. 4,806,461;
T-18 Ohashi et al U.S. Pat. No. 4,835,095;
T-19 Makino et al U.S. Pat. No. 4,853,322;
T-20 Daubendiek et al U.S. Pat. No. 4,914,014;
T-21 Aida et al U.S. Pat. No. 4,962,015;
T-22 Ikeda et al U.S. Pat. No. 4,985,350;
T-23 Tsaur et al U.S. Pat. No. 5,147,771;
T-24 Tsaur et al U.S. Pat. No. 5,147,772;
T-25 Tsaur et al U.S. Pat. No. 5,147,773;
T-26 Tsaur et al U.S. Pat. No. 5,171,659;
Tsaur et al U.S. Pat. No. 5,210,013; and
T-28 Antoniades et al U.S. Pat. No. 5,250,403

Any of the tabular grain emulsions, including F-EmL, M-EmL and/or S-EmL, can contain grain dopants to modify imaging characteristics. Any of the dopants disclosed by T-1 to T-28 inclusive above can be employed. Grain dopants are generally summarized in *Research Disclosure*, December 1989, Item 308119, Section I, subsection D, the disclosure of which is here incorporated by reference. Johnson and Wightman U.S. Pat. No. 5,164,292, discloses decreasing reciprocity failure and pressure sensitivity by preparing tabular grains by internal doping with selenium and iridium following the introduction of greater than half (preferably greater than 70%) of the total silver used to form the tabular grains has been precipitated. Preferred concentrations of iridium are in the iridium to silver atomic ratio range of from $1\times10^{-9}$ to $1\times10^{-5}$ (optimally $1\times10^{-8}$ to $1\times10^{-6}$). Preferred concentrations of selenium are in the selenium to silver atomic ratio range of from $1\times10^{-8}$ to $1\times10^{-4}$ (optimally $1\times10^{-7}$ to $1\times10^{-5}$).

Any of the tabular grain emulsions, including those of F-EmL, M-EmL and S-EmL, can be chemically sensitized by any convenient conventional technique. Any of the various chemical sensitizations taught by T-1 to T-24 inclusive can be employed. Still other useful chemical sensitizations are disclosed by Mifune et al U.S. Pat. No. 4,681,838 and Ihama et al U.S. Pat. Nos. 4,693,965 and 4,828,972. Generally middle chalcogen (e.g., sulfur or selenium) and noble metal (e.g., gold) sensitizations are preferred, but it is specifically contemplated to employ selective site epitaxial sensitizations (particularly silver chloride epitaxy) of the type disclosed by Maskasky U.S. Pat. No. 4,435,501.

When the tabular grain emulsions are used to record blue light, it is not essential that a spectral sensitizing dye be employed, since iodide the presence of iodide in the grain can boost native blue sensitivity, as discussed above. It is, however, preferred that blue spectral sensitizers be present in the blue recording emulsion layers. Particularly preferred blue spectral sensitizers for tabular grain emulsions are set out in Kofron et al (T-2 above). The minus blue recording layer units require the incorporation of at least one spectral sensitizer in each emulsion layer. A summary of generally useful spectral sensitizing dyes is contained in *Research Disclosure*, Item 308119, cited above, Section IV. In addition, the following patents teach specific selections of spectral sensitizing dyes for incorporation in tabular grain emulsions:

D-1 Sugimoto et al U.S. Pat. No. 4,581,329;
D-2 Ikeda et al U.S. Pat. No. 4,582,786;
D-4 Sasaki et al U.S. Pat. No. 4,592,621;
D-5 Sugimoto et al U.S. Pat. No. 4,609,621;
D-6 Shuto et al U.S. Pat. No. 4,675,279;
D-7 Yamada et al U.S. Pat. No. 4,678,741;
D-8 Shuto et al U.S. Pat. No. 4,720.451;
D-9 Miyasaka et al U.S. Pat. No. 4,818,675;
D-10 Arai et al U.S. Pat. No. 4,945,036; and
D-11 Nishikawa et al U.S. Pat. No. 4,952,491.

The emulsion layers and other layers of the multicolor photographic elements of the invention can contain various colloids alone or in combination as vehicles and vehicle extenders. A general summary of conventional vehicles and vehicle extenders is provided by *Research Disclosure*, Item 308119, cited above, Section IX. Gelatin containing reduced levels of methionine is specifically contemplated, as disclosed by Maskasky U.S. Pat. No. 4,713,320 (T-11), cited above. The vehicles can contain conventional hardeners, disclosed in Item 308119, Section X.

The dye image forming layer units can contain any convenient conventional choice of antifoggants and stabilizers. A summary conventional addenda serving this purpose is provided in *Research Disclosure*, Item 308119, Section VI. Specific selections of antifoggants and sensitizers in tabular grain emulsions are further illustrated in T-1 to T-22 inclusive, cited above.

The multicolor photographic elements of the invention are typically comprised of, in addition to the dye image forming layer units, interlayers between adjacent dye image forming layer units, an outermost protective layer or overcoat, an antihalation layer, and a support. The support (here understood to include subbing layers employed to promote adhesion of hydrophilic colloid layers) can take any conventional convenient form, conventional supports being summarized in *Research Disclosure*, Item 308119, Section XVII. Preferred supports are transparent film supports. Absorbing materials for antihalation layers and as well as ultraviolet absorbers for overcoats are summarized in Item 308119, Section VIII. The overcoat layer normally contains matting agent to avoid unwanted adhesion to adjacent surfaces. Conventional matting agent selections are summarized in Item 308119, Section XVI. The various layers coated on the support often additionally contain coating aids (summarized in Item 308119, Section XI) as well as plasticizers and lubricants (particularly in external layers) (summarized in Item 308119, Section XII). Antistatic agents can be incorporated in any of the layers described above, particularly the layers at or near the surface of the element. The overcoat layer often functions as an antistatic layer. Additionally, it is common practice to coat a separate antistatic layer on the side of the support opposite the emulsion layers (i.e., the back side of the support). Antistatic layers are summarized in Item 308119, Section XIII. Developing agents and development modifiers can also be incorporated in the element, usually in or adjacent an emulsion layer, such agents being summarized in Item 308119, Sections XXI and XXII.

Finally, each of the dye image forming layer units contain materials capable of forming a dye image, typically either a dye or dye precursor that can interact with developing silver or its reaction products (usually oxidized developing agent) to produce a dye image. Dye image providing materials are summarized in Item 308119, Section VII. The disclosure of each of the cited sections of Item 308119 is here incorporated by reference.

Preferred materials capable of forming a dye image are dye image forming couplers. Generally yellow dye image forming couplers are incorporated in blue recording layer units, magenta dye image forming couplers are incorporated in green recording layer units, and cyan dye image forming couplers are incorporated in red recording layer units. However, for the purpose of achieving an optimum overall image hue minor amounts of one or more of these dye image forming couplers can also be incorporated in one or more of the remaining layer units.

Examples of preferred couplers that form yellow dyes, typically acylacetamides, such as benzoylacetanilides and pivalylacetanilides, are described in such representative patents and publications as: U.S. Pat. Nos. 2,875,057; 2,407,210; 3,265,506; 2,298,443; 3,048,194; 4,022,620; 4,443,536; 3,447,928 and "Farbkuppler: Eine Literatürbersicht", published in Agfa Mitteilungen, Band III, pages 112–126 (1961).

Examples of preferred couplers that form cyan dyes, typically phenols and naphthols, are described in such representative patents and publications as: U.S. Pat. Nos. 2,772,162; 3,772,002; 4,526,864; 4,500.635; 4,254,212; 4,296,200; 4,457,559; 2,895,826; 3,002,936; 3,002,836; 3,034,892; 2,474,293; 2,423,730; 2,367,531; 3,041,236; 4,443,536; 4,124,396; 4,775,616; 3,779,763; 4,333,999 and "Farbkuppler: Eine Literatürbersicht", published in Agfa Mitteilungen, Band III, pages 156–175 (1961).

Examples of preferred couplers that form magenta dyes, typically pyrazolones, pyrazolotriazoles and benzimidazoles, are described in U.S. Pat. Nos. 2,600.788; 2,369,489; 2,343,703; 2,311,082; 3,824,250; 3,615,502; 4,076,533; 3,152,896; 3,519,429; 3,062,653; 2,908,573; 4,540.654; 4,443,536; 3,935,015; 3,451,820; 4,080,211; 4,215,195; 4,518,687; 4,612,278; and European Applications 284,239; 284,240; 240,852; 177,765 and "Farbkuppler: Eine Literatürbersicht", published in Agfa Mitteilungen, Band III, pages 126–156 (1961).

The following illustrates preferred choices for the construction of a multicolor photographic elements satisfying the requirements of the invention. The emulsions, having been described in detail, are not redescribed, but are understood to be present in layers 3, 4, 6, 7, 8, 10 and 11 in accordance with the previous description.

| | |
|---|---|
| 13. | OVERCOAT |
| 12. | UV |
| 11. | MOST SENSITIVE BLUE OR FAST YELLOW |
| 10. | LEAST SENSITIVE BLUE OR SLOW YELLOW |
| 9. | INTERLAYER |
| 8. | MOST SENSITIVE GREEN OR FAST MAGENTA |
| 7. | MID SENSITIVE GREEN OR MID MAGENTA |
| 6. | LEAST SENSITIVE GREEN OR SLOW MAGENTA |
| 5. | INTERLAYER |
| 4. | MOST SENSITIVE RED OR FAST CYAN |
| 3. | LEAST SENSITIVE RED OR SLOW CYAN |
| 2. | INTERLAYER |
| 1. | ANTIHALATION LAYER |
| SUPPORT | |

Overcoat/UV

The overcoat layer can be comprised of components known in the photographic art for overcoat layers including UV absorbers, matting agents, surfactants, and like. A UV layer can also be used which contains similar materials. UV absorbing dyes useful in this layer and the antihalation layer have the structure:

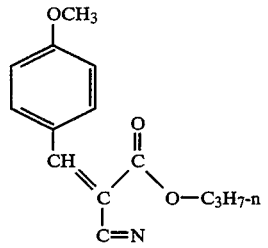

(1)

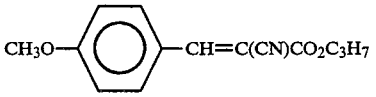

(2)

This layer, for example, also can contain dyes which can help in adjusting the photographic sensitivity of the element. Such dyes can be a green filter dye. A suitable green filter dye has the structure (3)

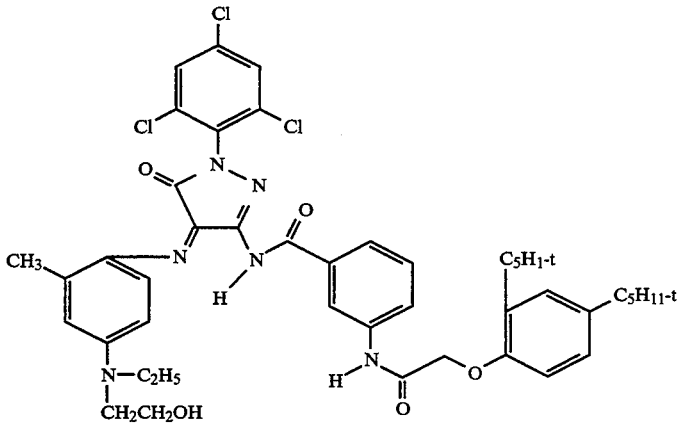

A suitable red filter dye has the structure (4)

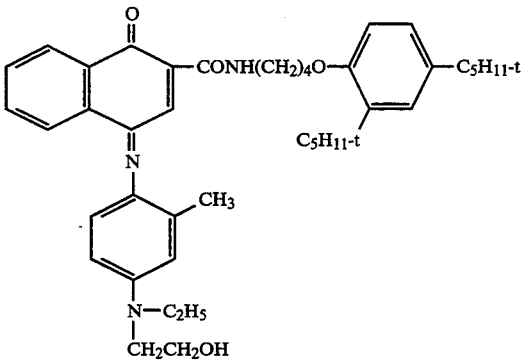

Other dyes that may be used include washout dyes of the type referred to herein and filter dyes that decolorize during the photographic process.

Fast Yellow

In the photographic element, the more blue sensitive layer or fast yellow layer contains a timed development inhibitor releasing coupler (DIR). The fast yellow layer is a coupler starved layer. The layer is preferably free of an image dye-forming coupler. As used herein by coupler starved is meant a condition in the layer in which there is less dye-forming coupler than is theoretically capable of reacting with all of the oxidized developing agent generated at maximum exposure. Couplers other than image dye-forming couplers can be present in this layer and such couplers can include, for example, timed development couplers as noted or non-timed DIR couplers and color correcting couplers. These other couplers are typically used at concentrations known in the photographic art and can produce yellow dye typically not more than about 3% of the total density of the yellow record.

Suitable timed DIR couplers used in the fast yellow layer comprise a DIR coupler (E) that is capable of releasing a mercapto-tetrazole development inhibitor comprising a substituent:

$$-X-COOR$$

wherein

X is alkylene of 1 to 3 carbon atoms and R is alkyl of 1 to 4 carbon atoms, and the sum of the carbon atoms X and R is 5 or less. The DIR coupler is typically a pivalylacetanilide coupler, such as described in U.S. Pat. No. 4,782,012, the disclosure of which is incorporated herein by reference.

The timed DIR coupler can be any timed DIR coupler useful in the photographic art which will provide a timed development inhibitor release.

That is, a development inhibitor releasing coupler containing at least one timing group (T) that enables timing of release of the development inhibitor group can be any development inhibitor releasing coupler containing at least one timing group known in the photographic art. The development inhibitor releasing coupler containing at least one timing group is represented by the formula:

$$COUP-T\frac{}{}T^1\frac{}{}_nQ^1$$

wherein

COUP is a coupler moiety, as described, typically a cyan, magenta or yellow dye-forming coupler moiety;

T and $T^1$ individually are timing groups, typically a timing group as described in U.S. Pat. Nos. 4,248,962 and 4,409,232, the disclosure of which are incorporated herein by reference;

n is 0 or 1; and $Q^1$ is a releasable development inhibitor group known in the photographic art. $Q^1$ can be selected from the INH group as described.

A preferred coupler of this type is described in U.S. Pat. No. 4,248,962.

Exemplary timed DIR couplers of this type are:

(5)

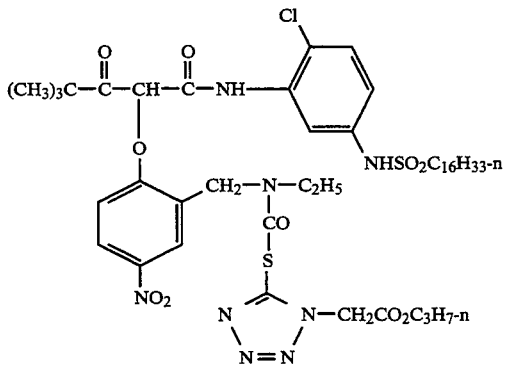

-continued (6)

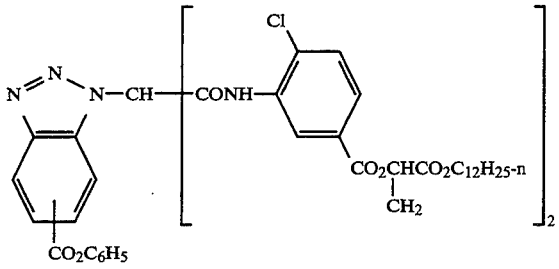

(7)

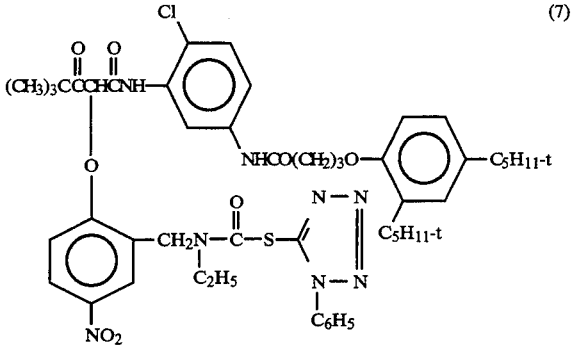

Highly suitable timed DIR couplers have the structure:

(8)

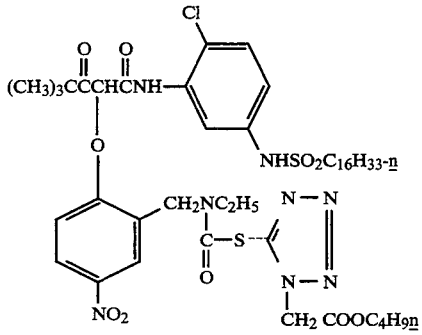

(9)

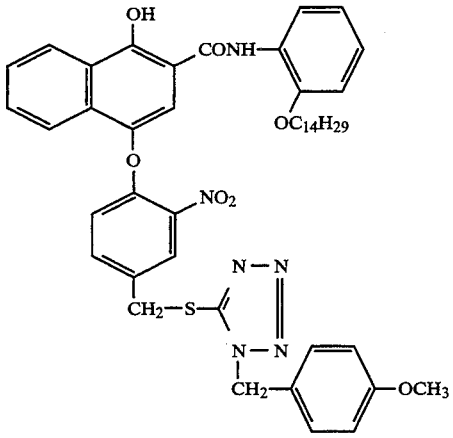

-continued (10)

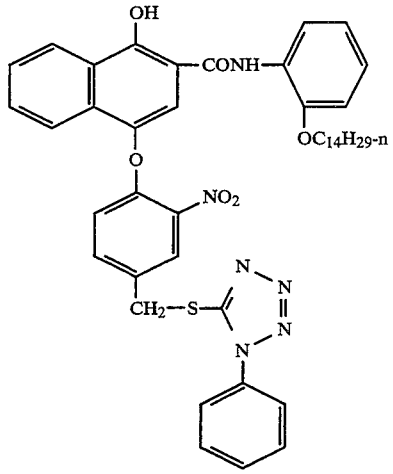

Color from the fast yellow layer is produced mostly as a result of oxidized developer formed in the fast yellow layer migrating to the adjacent slow yellow layer and reacting to form yellow dye.

Other couplers that are development inhibitor releasing couplers as described include those described in for example U.S. Pat. Nos. 4,248,962; 3,227,554; 3,384,657; 3,615,506; 3,617,291; 3,733,201; and U.K. 1,450,479. Preferred development inhibitors are heterocyclic compounds, such as mercaptotetrazoles, mercaptotriazoles, mercaptooxadiazoles, selenotetrazoles, mercaptobenzothiazoles, selenobenzothiazoles, mercaptobenzoxazoles, selenobenzoxazoles, mercaptobenzimidazoles, selenobenzimidazoles, benzotriazoles, benzodiazoles and 1,2,4-triazoles, tetrazoles, and imidazoles.

Slow Yellow Layer

In the photographic element, the less blue sensitive layer or slow yellow layer contains a yellow image dye-forming coupler. Such yellow image dye-forming coupler can be any yellow dye-forming coupler useful in the photographic art.

Couplers that are yellow image dye-forming couplers are typically acylacetamides, such as benzoylacetanilides and pivalylacetanilides, such as described in the photographic art for forming yellow dyes upon oxidative coupling.

The yellow dye-forming coupler in the slow yellow layer is typically a pivalylacetanilide coupler containing a hydantoin coupling-off group. Such a coupler is illustrated by the formula:

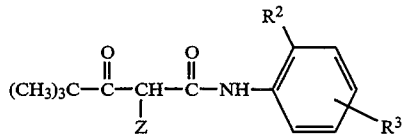

wherein $R^2$ is chlorine, bromine or alkoxy;

$R^3$ is a ballast group, such as a sulfonamide or carboxamide ballast group; and Z is a coupling-off group, preferably a hydantoin coupling off group as described in U.S. Pat. No. 4,022,620, the disclosure of which is incorporated herein by reference.

Exemplary yellow dye-forming couplers suitable for the slow yellow or less sensitive blue layer are:

(11)

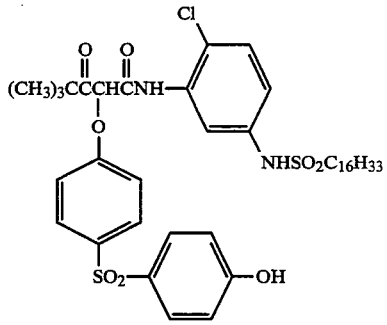

(12)

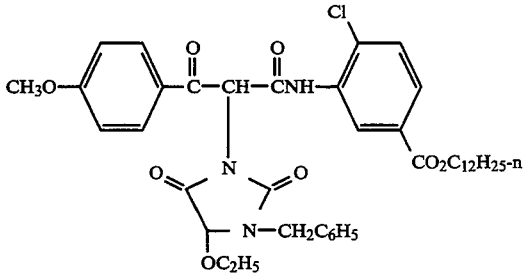

(13)

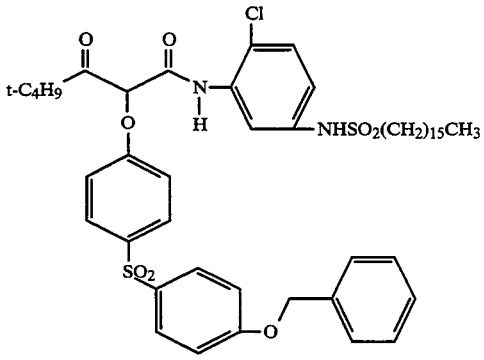

A preferred yellow dye-forming coupler for the slow yellow layer has the structure:

(14)

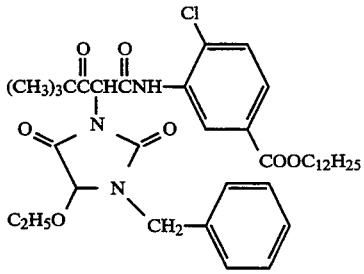

Timed or non-timed DIR couplers as noted with respect to the fast yellow layer may also be used in the slow yellow lower.

Interlayer

In the photographic element a yellow filter layer is provided between the slow yellow and the fast magenta. This layer can comprise Carey Lea silver (CLS), bleach accelerating silver salts, any oxidized developer scavenger known in the photographic art, such as described in U.S. Pat. No. 4,923,787, and a dye to enable improved image sharpness or to tailor photographic sensitivity of the element. A preferred oxidized developer scavenger is:

(15)

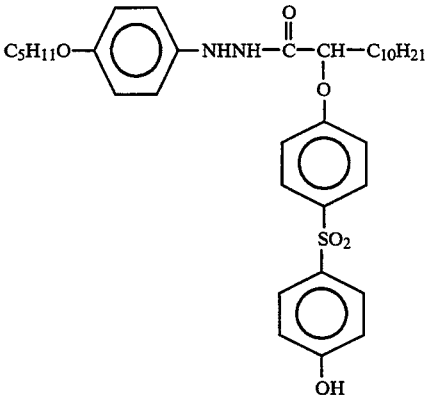

Other oxidized developer scavenger useful in the invention include:

(16)

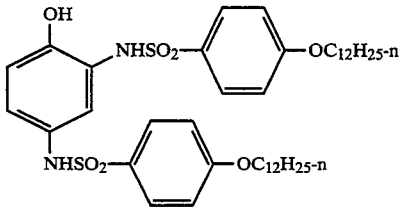

(17)

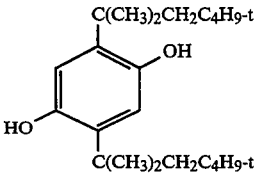

When finely divided silver such as Carey Lea silver is used in the yellow filter layer, and when a bleach accelerating releasing coupler (BARC) is present in the photographic element, then preferably an interlayer is provided between the yellow filter and other layers in the photographic element containing a dye image forming coupler. If a bleach accelerating silver salt (BASS) is used, preferably in the yellow filter layer, then it is preferred to provide an interlayer to isolate the BASS containing layer from the remainder of the film. This interlayer may contain the oxidized developer scavenger noted above. Further, the interlayer may be contiguous with the yellow filter layer and may be disposed on both sides of the yellow filter layer. Representative bleach accelerating silver salts are disclosed in U.S. Pat. No. Nos. 4,865,965; 4,923,784; 4,163,669. The bleach accelerating silver salts can comprise silver salts of mercapto proprionic acid. BARC and BASS compounds may be used in combination in the element.

Other representative bleach accelerating silver salts which may be used in the interlayer are structurally shown as follows:

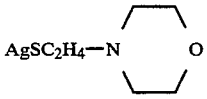

-continued

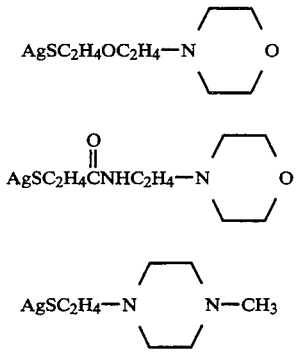

$AgSC_2H_4OC_2H_4N(CH_3)_2$
$AgSC_2H_4N(C_2H_4OCH_3)_2$

Instead of using finely divided silver in the yellow filter layer, filter dyes may be used. When filter dyes are used, then the interlayer contiguous or adjacent the yellow filter layer may be omitted. Oxidized developer scavenger as referred to above may be used in the yellow filter layer with the filter dye. Examples of filter dyes such as washout or decolorizing dyes useful in the present invention are described in U.S. Pat. No. 4,923,788 incorporated herein by reference. Such filter dyes have the formula:

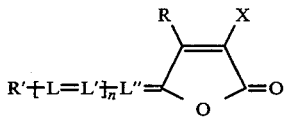

wherein R is substituted or unsubstituted alkyl or aryl, X is an electron withdrawing group, R′ is substituted or unsubstituted aryl or a substituted or unsubstituted aromatic heterocyclic nucleus, and L, L′, and L″ are each independently a substituted or unsubstituted methine group.

Preferred alkyl groups include alkyl of from 1 to 20 carbon atoms, including straight chain alkyls such as methyl, ethyl, propyl, butyl, pentyl, decyl, dodecyl, and so on, branched alkyl groups such as isopropyl, isobutyl, t-butyl, and the like. These alkyl groups may be substituted with any of a number of known substituents, such as sulfo, sulfato, sulfonamide amide, amido, amino, carboxyl, halogen, alkoxy, hydroxy, phenyl, and the like. The substituents may be located essentially anywhere on the alkyl group. The possible substituents are not limited to those exemplified, and one skilled in the art could easily choose from a number of substituted alkyl groups that would provide useful compounds according to the formula.

Preferred aryl groups for R include aryl of from 6 to 10 carbon atoms (e.g., phenyl, naphthyl), which may be substituted. Useful substituents for the aryl group include any of a number of known substituents for aryl groups, such as sulfo, sulfato, sulfonamido (e.g., butanesulfonamido), amido, amino, carboxyl, halogen, alkoxy, hydroxy, acyl, phenyl, alkyl, and the like.

The filter dyes may be used in combination with the finely divided silver.

It will be appreciated that permanent yellow filter dyes can be used instead of CLS or washout-filter dyes, such permanent dyes, for example, have structures:

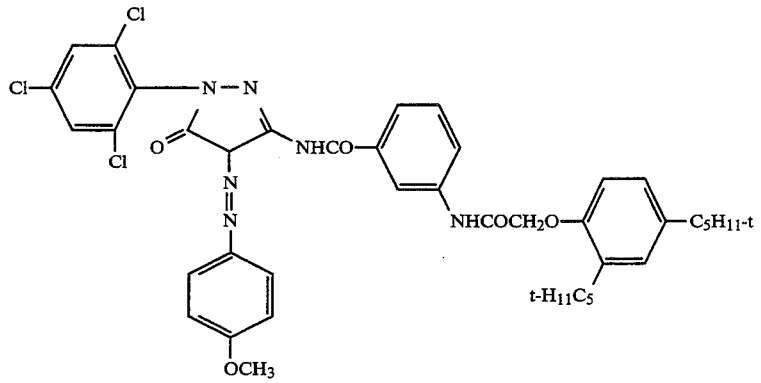

(18)

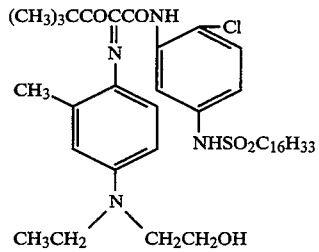

(19)

A microcrystalline dye that is capable of being decolorized during processing useful in the invention has the structure:

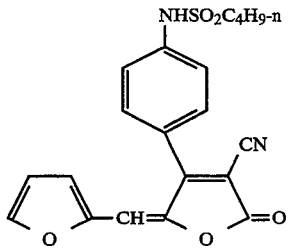
(20)
Fast Magenta Layer
The most green sensitive layer or fast magenta layer comprises a magenta image dye-forming coupler, a timed development inhibitor releasing coupler (DIR), preferably a non-timed DIR coupler and preferably a masking coupler.
Exemplary pyrazolotriazole couplers that form magenta dyes include:
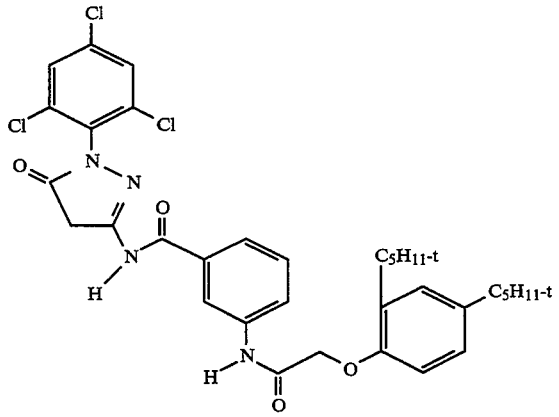
(21)
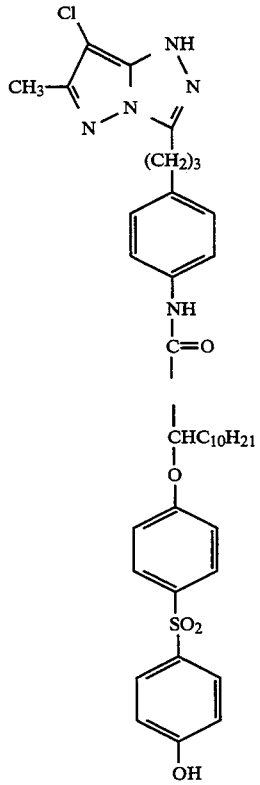
(22)

-continued (23)

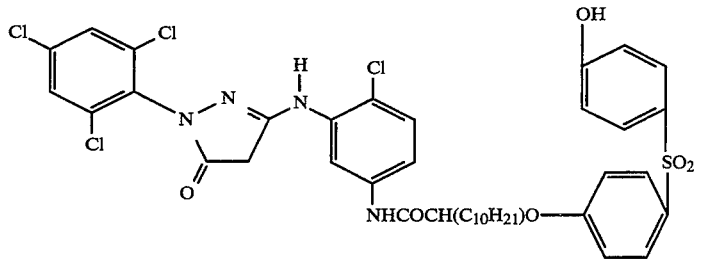

(24)

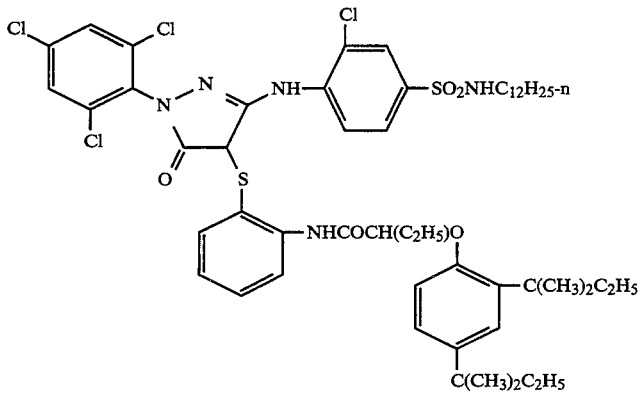

(25)

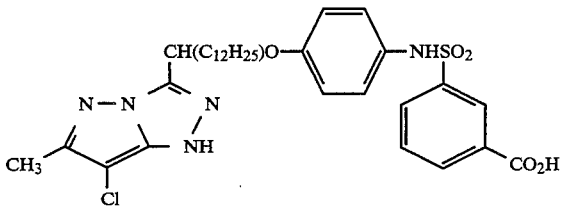

A specifically preferred magenta image dye-forming coupler has the structure:

(26)

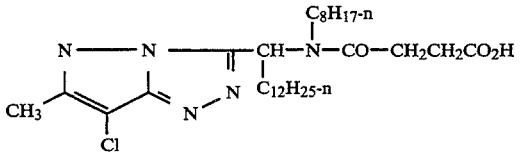

Suitable timed DIR couplers comprise a DIR coupler that is capable of releasing a mercaptotetrazole development inhibitor as noted with respect to the fast yellow layer.

The masking coupler can be any masking coupler suitable for use in a photographic element. Preferably the masking coupler has structure:

(27)

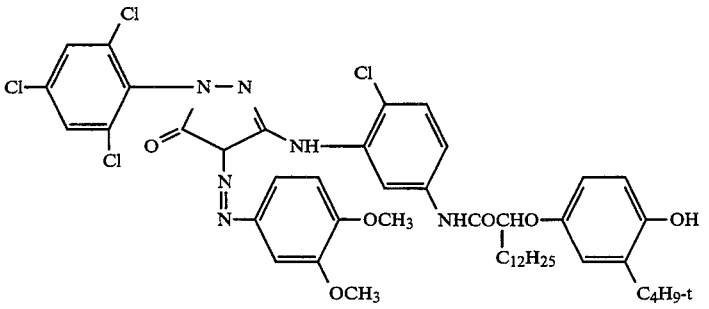

or

-continued (28)

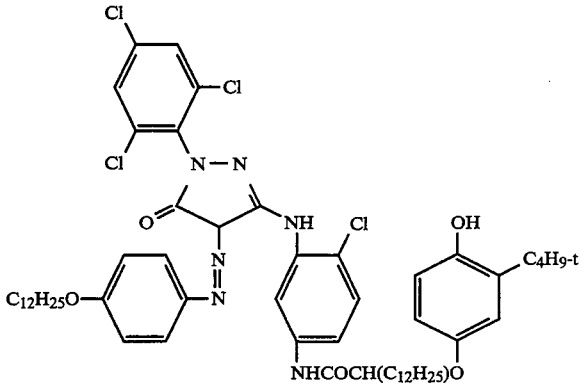

The masking coupler can be placed in any of the three magenta imaging layers.

The non-timed DIR coupler used in the fast magenta layer can be any non-timed DIR coupler known in the photographic art. Examples of such non-timed DIR couplers are disclosed in U.S. Pat. No. 3,227,554 incorporated herein by reference.

Preferred non-timed DIR couplers have the structure:

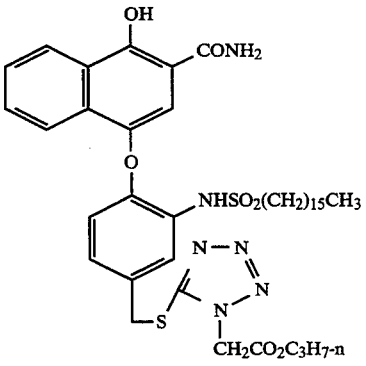

or

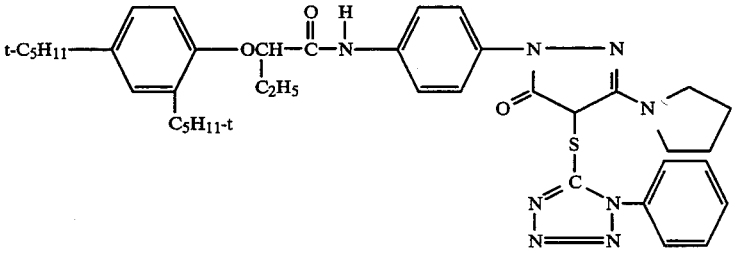

(30)

Mid Magenta Layer

The mid-magenta or mid green sensitive layer comprises at least one first magenta image dye-forming coupler, and preferably at least one second magenta image dye-forming coupler, preferably a non-timed DIR coupler.

A typical magenta image dye-forming coupler is a pyrazolotriazole. A preferred magenta image dye-forming coupler is coupler (26). Coupler (22) is another preferred magenta image dye forming coupler.

Suitable non-timed DIR couplers useful in the mid magenta layer are as described for the fast magenta layer and can be preferred coupler (30), for example.

It is also preferred to incorporate for color correction a cyan image dye-forming coupler, such as one of the following structures:

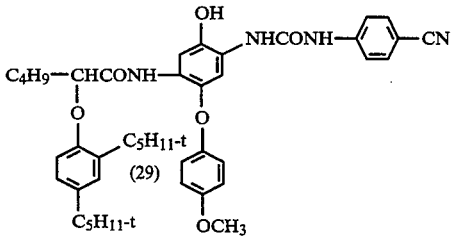

(31)

(29)

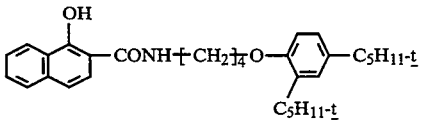

(32)

-continued

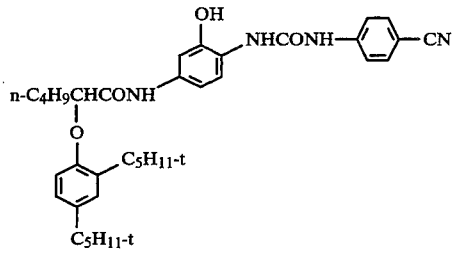

(33)

Coupler (34) may also be used in the mid magenta layer.

Slow Magenta Layer

The slow magenta layer contains at least one magenta image dye-forming coupler which is preferably a bleach accelerating releasing coupler (BARC). The slow magenta layer also contains a development inhibiting releasing coupler (DIR) preferably a non-timed DIR.

The bleach accelerator releasing coupler can be any bleach accelerator releasing coupler known in the photographic art. Combinations of such couplers are also useful. The bleach accelerator releasing coupler can be represented by the formula:

$$COUP\text{-}[T^2]_m S\text{-}R^3\text{-}R^4$$

wherein

COUP is a coupler moiety as described, typically a cyan, magenta or yellow dye-forming coupler moiety;

$T^2$ is a timing group known in the photographic art, typically a timing group as described in U.S. Pat. Nos. 4,248,962 and 4,409,323, the disclosures of which are incorporated herein by reference;

m is 0 or 1;

$R^3$ is an alkylene group, especially a branched or straight chain alkylene group, containing 1 to 8 carbon atoms; and $R^4$ is a water-solubilizing group, preferably a carboxy group.

Typical bleach accelerator releasing couplers are described in, for example, European Patent 193,389, the disclosure of which is incorporated herein by reference.

A suitable bleach accelerator releasing coupler has the structure:

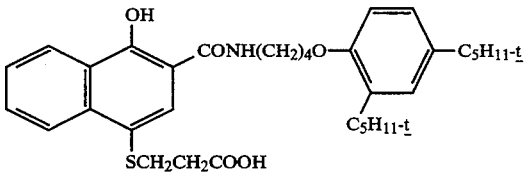

(34)

A preferred bleach accelerator releasing coupler has the structure:

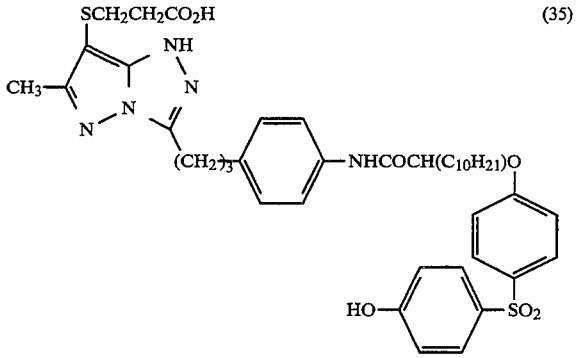

(35)

Combinations of bleach accelerating couplers may be used the bleach accelerating coupler can be used in the other imaging layer including the magenta imaging layers.

The DIR coupler for the slow magenta layer can be the same DIR coupler used for the fast magenta or mid magenta layer.

A hydrophilic colloid (e.g. gelatin or a gelatin derivative) interlayer may be added between the fast and mid or mid and slow magenta layers, but an oxidized developing agent scavenger cannot be present.

Cyan dye-forming coupler may be used in the slow magenta layer as in the mid magenta layer.

Interlayer

The interlayer between the slow magenta and the fast cyan layers can contain an oxidized developer scavenger or dyes that are added to adjust photographic speed or density of the film. A preferred oxidized developer scavenger is as described for the yellow filter layer. The dyes can be the same as for the UV layer and an additional dye which is useful in this layer can include coupler (19).

Fast Cyan Layer

The fast cyan or most red sensitive layer contains a cyan image dye-forming coupler, a first non-timed DIR coupler, preferably a second non-timed DIR coupler, a masking coupler and a yellow image dye-forming correcting coupler.

The cyan image dye-forming coupler useful in the fast cyan layer is as described for the mid magenta layer. The preferred cyan image dye-forming coupler is the same preferred coupler as for the mid magenta layer.

The first and second non-timed DIR couplers in the fast cyan layer or most red sensitive layer can be any development inhibitor releasing coupler known in the photographic art. Typical DIR couplers are described in, for example, U.S. Pat. Nos. 3,227,554; 3,384,657; 3,615,506; 3,617,291; 3,733,201 and U.K. 1,450,479. Such DIR couplers upon oxidative coupling preferably do not contain a group that times or delays release of the development inhibitor group. The DIR coupler is typically represented by the formula:

COUP—INH wherein COUP is a coupler moiety and INH is a releasable development inhibitor group that is bonded to the coupler moiety at a coupling position. The coupler moiety COUP can be any coupler moiety that is capable of releasing the INH group upon oxidative coupling.

The coupler moiety (COUP) is, for example, a cyan, magenta or yellow forming coupler known in the photographic art. The COUP can be ballasted with a ballast group known in the photographic art. The COUP can also be monomeric, or it can form part of a dimeric, oligomeric or polymeric coupler, in which case more than one inhibitor group can be contained in the DIR coupler.

The releasable development inhibitor group (INH) can be any development inhibitor group known in the photographic art. Illustrative INH groups are mercaptotetrazoles, selenotetrazoles, mercaptobenzothiazoles, selenobenzothiazoles, mercaptobenzimidazoles, selenobenzimidazoles, mercaptobenzoxazoles, selenobenzoxazoles, mercaptooxadiazoles, mercaptothiadiazoles, benzotriazoles, and benzodiazoles. Preferred inhibitor groups are mercaptotetrazoles and benzotriazoles. Particularly preferred inhibitor groups are described in for example U.S. Pat. Nos. 4,477,563 and 4,782,012.

Preferred DIR couplers within COUP-INH are coupler (29) and the following:

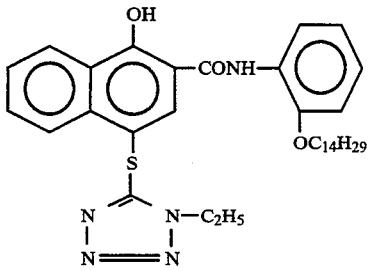

(36)

Preferred timed DIR couplers which may be used in this layer have the structures of couplers (5), (9) and (10) and

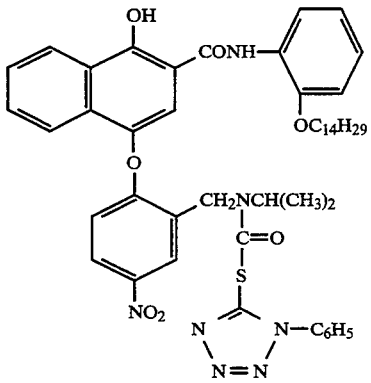

(37)

The second non-timed DIR coupler which may be used in the fast cyan layer has the structure.

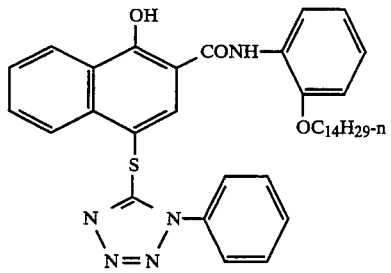

(38)

The masking coupler in the most red sensitive layer is typically a cyan dye-forming masking coupler, such as a naphthol cyan dye-forming masking coupler.

A preferred cyan dye-forming masking coupler for the cyan dye-forming layers of the photographic element is:

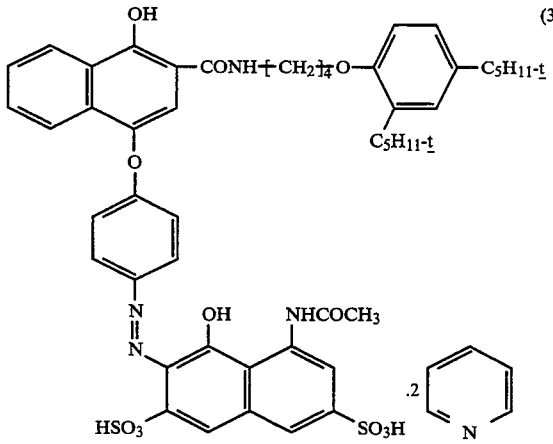

(39)

The yellow image dye-forming coupler can be any such coupler useful in the photographic art with its use in the cyan record sometimes referred to as a color correcting coupler. Couplers that are yellow dye forming couplers are typically acylacetamides, such as benzoylacetanilides and pivalylacetanilides as noted. Such couplers are described in such representative patents and publications as noted earlier.

The yellow dye-forming coupler is preferably a pivalylacetanilide comprising a phenoxy coupling off group. Such yellow dye-forming couplers have the same structures as used in the slow yellow layer and the preferred coupler is coupler (11).

Slow Cyan Layer

The slow cyan or less sensitive red layer contains a cyan image dye-forming coupler, a timed DIR coupler or development inhibitor anchimeric releasing coupler (DIAR), a non-timed DIR coupler, and a yellow image dye-forming correcting coupler.

The cyan image dye-forming coupler can be the same cyan image dye-forming coupler as used in the fast cyan layer. Also, the yellow image dye-forming correcting coupler can be the same yellow image dye-forming coupler as used in the fast cyan layer.

An illustrative development inhibitor releasing coupler containing at least one timing group (T) that enables timing of release of the development inhibitor group preferably has the structure of coupler (37).

The non-timed DIR coupler can be the same as for the fast cyan layer.

Interlayer

An interlayer is provided between the slow cyan layer and the antihalation layer. The interlayer can contain an oxidized developer scavenger. A preferred oxidized developer scavenger is as described for the yellow filter layer. This interlayer solves a problem of increased fog resulting from interaction of bleach accelerating releasing coupler with silver in the antihalation layer. Thus, providing this interlayer between a BARC containing layer anywhere in the element and the antihalation layer so as to isolate the antihalation layer from layers containing dye-forming couplers, permits the advantageous use of a BARC for good silver bleaching without increasing fog or Dmin with respect to the antihalation layer, for example, while maintaining desired acutance.

Antihalation Layer

The antihalation layer can contain very fine gray or black silver filamentary or colloidal silver, e.g. CLS, and preferably a UV absorbing dyes, gelatin and colored dyes such as coupler (19) to provide density to the film.

While the antihalation layer has been described with respect to silver, other materials can be substituted for or used in conjunction with the silver. That is, instead of using finely divided silver in the antihalation layer, filter dyes such as washout-dyes or decolorizing dyes of the type referred to herein may be used. When filter dyes are used in the antihalation layer, the interlayer adjacent the antihalation layer may be omitted. Oxidized developer scavenger may be omitted from the antihalation layer when filter dyes are used. Examples of dyes which may be used in the antihalation layer are described in U.S. Pat. No. 4,923,788 as noted earlier.

Bleach accelerating silver salts as described with respect to the yellow filter layer may be used in the antihalation layer in conjunction with the finely divided silver. When bleach accelerating silver salts are used in antihalation it is preferred to use the interlayer over the antihalation layer as noted to minimize fog or Dmin.

EXAMPLES

The subscripts E and C are used to distinguish structures satisfying the requirement of the invention from comparative structures.

Emulsions

The following emulsions were prepared for the purpose of constructing high performance layer units satisfying the requirements of the invention and comparative layer units:

FM-1

A tabular grain silver bromoiodide emulsion was prepared in which iodide was introduced at a uniform 6 mole percent iodide concentration throughout halide ion introduction. Iridium in an atomic ratio of Ir to total silver of $3\times10^{-6}$ was introduced during the precipitation to improve reciprocity characteristics. The following is a detailed description of the emulsion preparation procedure:

Into a four liter aqueous bone gelatin solution containing 12 g of bone gelatin and 28.4 g of sodium bromide at 80° C. were added in one minute 28 ml of 2.75 molar silver nitrate solution. Four liters of aqueous bone gelatin solution, containing 176 g of gelatin, was then added, followed by mixing for 10 minutes. Double jet addition was then undertaken to add over 48 minutes while maintaining a constant pBr of 1.96 by adding through one jet an aqueous sodium bromide and potassium iodide solution consisting of 2.58 molar sodium bromide and 0.165 molar potassium iodide while adding through a second jet an aqueous silver nitrate solution consisting of 2.75 molar silver nitrate. Addition flow rates were accelerated 4.5 times from start to finish. A total of 9.9 moles of silver bromoiodide emulsion was precipitated. At the stage of precipitation when 70 percent of the total silver had been introduced, 0.25 mg of potassium hexachloroiridate (IV) dissolved in 120 cc of 0.1N nitric acid was added to the reaction vessel.

The emulsion was cooled to 40° C. and washed by ultrafiltration until the pBr was 3.55. A bone gelatin solution (50% by weight gelatin) in the amount of 500 grams was then blended into the emulsion.

| Grain Characteristics | |
|---|---|
| Average ECD: | 1.59 μm; |
| Average thickness: | 0.139 μm; |
| Average tabularity | 82; |
| TGPA*: | >75%; |
| (*tabular grain projected area as a percentage of total grain projected area) | |
| Total iodide | 6 mole percent. |

When cooled to 6° K. and stimulated with a helium-cadmium laser at 325 nm, the emulsion exhibited a single emission peak at about 540 nm. No emission peak was observed in the spectral region of from 570 to 590 nm. Emission intensity at 575 nm was less than 15 percent of peak emission.

MM-1

A tabular grain silver bromoiodide emulsion was prepared in which iodide was introduced at a uniform 6 mole percent iodide concentration throughout halide ion introduction similarly as in the preparation of FM-1, except that the temperature within the reaction vessel during concurrent addition of silver and halide salts was reduced to 70° C. and the pBr within the reaction vessel during grain growth was maintained at 2.03. The iodide ion was introduced at a uniform 6 mole percent concentration throughout halide addition.

| Grain Characteristics | |
|---|---|
| Average ECD: | 0.99 μm; |
| Average thickness: | 0.127 μm; |
| Tabularity | 61; |
| TGPA: | >75%; |
| Total iodide | 6 mole percent. |

When cooled to 6° K. and stimulated with a helium-cadmium laser at 325 nm, the emulsion exhibited a single emission peak at about 540 nm. No emission peak was observed in the spectral region of from 570 to 590 nm. Emission intensity at 575 nm was less than 15 percent of the peak emission.

MM-2

A tabular grain silver bromoiodide emulsion was prepared similarly as in the preparation of FM-1, except that the temperature within the reaction vessel during concurrent addition of silver and halide salts was reduced to 65° C., the pBr within the reaction vessel during grain growth was maintained at 2.00, and the iodide ion was introduced at a uniform 3 mole percent concentration throughout halide addition.

| Grain Characteristics | |
|---|---|
| Average ECD: | 0.91 μm; |
| Average thickness: | 0.112 μm; |
| Tabularity | 73; |
| TGPA: | >75%; |
| Total iodide | 3 mole percent. |

When cooled to 6° K. and stimulated with a helium-cadmium laser at 325 nm, the emulsion exhibited a single emission peak at about 530 nm. No emission peak was observed in the spectral region of from 570 to 590 nm. Emission intensity at 575 nm was less than 15 percent of the peak emission.

SM-1

A tabular grain silver bromoiodide emulsion was prepared in which iodide was introduced at a uniform 6 mole percent iodide concentration throughout halide ion introduction similarly as in the preparation of FM-1, except that the temperature within the reaction vessel during concurrent addition of silver and halide salts was reduced to 60° C. and 1 mg of potassium hexachloroiridate (IV) was introduced.

| Grain Characteristics | |
|---|---|
| Average ECD: | 0.47 μm; |
| Average thickness: | 0.10 μm; |
| Tabularity | 47; |
| TGPA: | >75%; |
| Total iodide | 6.0 mole percent. |

When cooled to 6° K. and stimulated with a helium-cadmium laser at 325 nm, the emulsion exhibited a single emission peak at about 540 nm. No emission peak was observed in the spectral region of from 570 to 590 nm. Emission intensity at 575 nm was less than 15 percent of the peak emission.

SM-2

A tabular grain silver bromoiodide emulsion was prepared in which iodide was introduced at a uniform 0.5 mole percent iodide concentration throughout halide ion introduction similarly as in the preparation of SM-1, except that the temperature within the reaction vessel during concurrent addition of silver and halide salts was reduced to 55° C. and the pBr within the reaction vessel during double jet addition was maintained at 2.17.

| Grain Characteristics | |
|---|---|
| Average ECD: | 0.60 μm; |
| Average thickness: | 0.10 μm; |
| Tabularity | 60; |
| TGPA: | >75%; |
| Total iodide | 0.5 mole percent. |

When cooled to 6° K. and stimulated with a helium-cadmium laser at 325 nm, the emulsion exhibited a single emission peak at about 500 nm. No emission peak was observed in the spectral region of from 570 to 590 nm. Emission intensity at 575 nm was less than 15 percent of the peak emission.

SM-3

This emulsion was prepared by blending emulsions MM-2 and SM-2 in equal silver amounts. The overall iodide content was 1.75 mole percent, based on silver.

A summary of emulsion characteristics is provided below in Table I.

TABLE I

| Emul. | ECD (μm) | t (μm) | ECD/$t^2$ | Tot. I (M%) |
|---|---|---|---|---|
| FM-1 | 1.59 | 0.139 | 82 | 6 |
| MM-1 | 0.99 | 0.127 | 61 | 6 |
| MM-2 | 0.91 | 0.112 | 73 | 3 |
| SM-1 | 0.47 | 0.10 | 47 | 6 |
| SM-2 | 0.60 | 0.10 | 60 | 0.5 |
| SM-3 | 0.75 | 0.106 | 66.5 | 1.75 |

Multicolor Format

To demonstrate the advantages of the high performance dye image forming layer units of the invention varied combinations of the emulsions described above were employed in a common multicolor photographic element format. Only the emulsions contained in the magenta dye image forming green recording layer unit were varied.

Each of the emulsions in the magenta dye image forming green recording layer unit were optimally sulfur and gold sensitized in the presence of the finish modifier 3-[2-(methylsulfonylcarbamoyl)ethyl]benzothiazolium tetrafluoroborate. The antifoggant phenylmercaptotetrazole was present during the chemical sensitization of FM-1 and -2 and MM-1 and -2. Each of the emulsions in the green recording layer unit were spectrally sensitized with a combination of anhydro-5-chloro-9-ethyl-5'-phenyl-3'-(3-sulfobutyl)-3-(3-sulfopropyl)oxacarbocyanine hydroxide, sodium salt and anhydro 11-ethyl-1,1'-bis(3-sulfopropyl)naphth[1,2-d]oxazolocarbocyanine hydroxide, sodium salt.

The following layers were in each instance coated onto a transparent cellulose acetate film support:

| Support | mg/$m^2$ | mg/$ft^2$ | |
|---|---|---|---|
| Layer 1 | | | |
| Antihalation Layer | 215 | 20 | Black colloidal silver |
| | 91 | 8.5 | UV absorbing dye coupler (1) |
| | 91 | 8.5 | UV absorbing dye coupler (2) |
| | 140 | 13 | Blue filter dye (19) |
| | 2422 | 225 | Gelatin |
| Layer 2 | | | |
| Interlayer | 54 | 5.0 | D-Ox scavenging coupler (15) |
| | 861 | 80.0 | Gelatin |
| Layer 3 | | | |
| Least Red Sensitive Layer | 1398 | 130 | Red sensitized silver iodobromide emulsion (4.5% iodide, tabular grains with average ECD 1.1 μm and average grain thickness 0.1 μm), |
| | 538 | 50 | Red sensitized silver iodobromide emulsion (0.5% iodide, cubic grains with average edge length 0.21 μm) |
| | 699 | 65 | Cyan dye forming image coupler (33) |
| | 36 | 3.3 | Development inhibitor release (DIR) coupler (37) |
| | 97 | 9.0 | Yellow dye-forming image coupler (11) |

-continued

| Support | mg/m² | mg/ft² | |
|---|---|---|---|
| | 3078 | 286 | Gelatin |
| Layer 4 | | | |
| Most Red-Sensitive Layer | 1291 | 120 | Red sensitized silver iodobromide emulsion (3% iodide, octahedral grains with average grain ECD 0.90 μm) |
| | 49.4 | 4.6 | Cyan dye-forming image coupler (33) |
| | 32.3 | 3 | Cyan dye-forming masking coupler (39) |
| | 50 | 4.6 | Cyan dye-forming development DIR coupler (36) |
| | 11 | 1.0 | Yellow dye-forming image coupler (11) |
| | 2368 | 220 | Gelatin |
| | 4.3 | 0.4 | Cyan dye-forming development DIR coupler (38) |
| Layer 5 | | | |
| Interlayer | 129 | 12 | Oxidized development scavenger coupler (15) |
| | 861 | 80 | Gelatin |
| | 5.4 | 0.5 | Green filter dye (3) |
| | 38 | 3.5 | Blue filter dye (19) |
| Layer 6 | | | |
| Least Green-Sensitive Layer (S-EmL) | 783 | 70 | Green sensitized silver iodobromide emulsion selected as described below |
| | 172 | 16.0 | Magenta dye-forming image coupler that releases a bleach accelerating fragment (35) |
| | 12 | 1.1 | Magenta dye-forming development DIR coupler (30) |
| | 1507 | 140 | Gelatin |
| Layer 7 | | | |
| Mid Green-Sensitive Layer (M-EmL) | 969 | 90.0 | Green sensitized silver iodobromide emulsion selected as described below |
| | 75.0 | 7.0 | Magenta dye-forming image coupler (22) |
| | 54.0 | 5.0 | Magenta dye-forming image coupler (26) |
| | 9.0 | 0.8 | Magenta dye-forming development DIR coupler (30) |
| | 11.0 | 1.0 | Cyan dye forming, image coupler (33) |
| | 1238 | 115.0 | Gelatin |
| Layer 8 | | | |
| Most Green-Sensitive Layer (F-EmL) | 753.0 | 70.0 | Green sensitized silver iodobromide emulsion selected as described below |
| | 22.0 | 2.0 | Magenta dye-forming image coupler (26) |
| | 13.0 | 1.2 | Magenta dye-forming development DIR coupler (30) |
| | 65.0 | 6.0 | Magenta dye-forming development masking coupler (27) |
| | 26.0 | 2.4 | Yellow dye-forming development DIR coupler (8) |
| | 969 | 90.0 | Gelatin |
| Layer 9 | | | |
| Interlayer | 75.0 | 7.0 | D-Ox scavenging coupler (15) |
| | 129.0 | 12.0 | Developer bleachable yellow filter dye (20) |
| | 861.0 | 80.0 | Gelatin |
| Layer 10 | | | |
| Least Blue-Sensitive Layer | 215.0 | 20.0 | Blue sensitized silver iodobromide emulsion (6% iodide, octahedral grains with average ECD of 0.65 μm) |
| | 107.5 | 10.0 | Blue sensitized silver iodobromide emulsion (5% iodide, octahedral grains with average grain ECD of 0.40 μm) |
| | 322.5 | 30.0 | Blue sensitized silver iodobromide emulsion (5% iodide, octahedral grains with average grain ECD of 0.23 μm) |
| | 924.5 | 86.0 | Yellow dye-forming image coupler (14) |
| | 1420 | 132.0 | Gelatin |
| Layer 11 | | | |
| Most Blue-Sensitive Layer | 397.8 | 37.0 | Blue sensitized silver iodobromide emulsion (6% iodide, octahedral grains with average grain ECD of 1.0 μm) |
| | 11.0 | 1.0 | Yellow dye-forming development DIR coupler (8) |
| | 1076 | 100.0 | Gelatin |
| Layer 12 | | | |
| First Protective Layer | 215.0 | 20.0 | Unsensitized silver bromide Lippman emulsion (0.04 μm) |
| | 108.0 | 10.0 | UV absorbing dye (1) |
| | 129.0 | 12.0 | UV absorbing dye (2) |
| | 753.0 | 70.0 | Tricresyl phosphate |
| | 1345 | 125.0 | Gelatin |
| | 40 | 0.4 | Green absorbing dye (3) |
| | 20 | 0.2 | Red absorbing dye (4) |
| Layer 13 | | | |
| Second Protective Layer | 44.0 | 4.1 | Anti-matte poly(vinyltoluene) beads |
| | 883.0 | 82.0 | Gelatin |

In the multilayer format above M-EmL was about 0.5 log E slower than F-EmL while S-EmL was about 0.8 log E slower than M-EmL in each of the multicolor elements described below, except when SM-3 was employed. When SM-3 was employed, S-EmL was about 0.4 log E slower than M-EmL. All of the emulsion layers contained 1.75 gm of 4-hydroxy-6-methyl-1,3,3a,7-tetraazaindene antifoggant per mole of silver.

Multicolor Photographic Elements

Each of the photographic elements was identically exposed using an Eastman TM 1B sensitometer and processed in a Kodak C-41 TM process, described in the *British Journal of Photography*, pp. 196–198 (1988).

Example 1 (Control)

A control multicolor photographic element was constructed as described above with the following emulsion selections for the magenta dye image forming green recording layer unit:

| | |
|---|---|
| F-EmL | FM-1 |
| M-EmL | MM-1 |
| S-EmL | SM-1 |

By referring back to Table I it can be seen that the purpose of selecting this control for comparison was to demonstrate the performance of a dye image forming layer unit containing three tabular grain silver bromoiodide emulsion layers differing in speed employing the same level of iodide in each of the emulsion layers and employing the relatively uniform iodide distribution within the grains produced by run iodide addition throughout grain precipitation.

Figure 2:
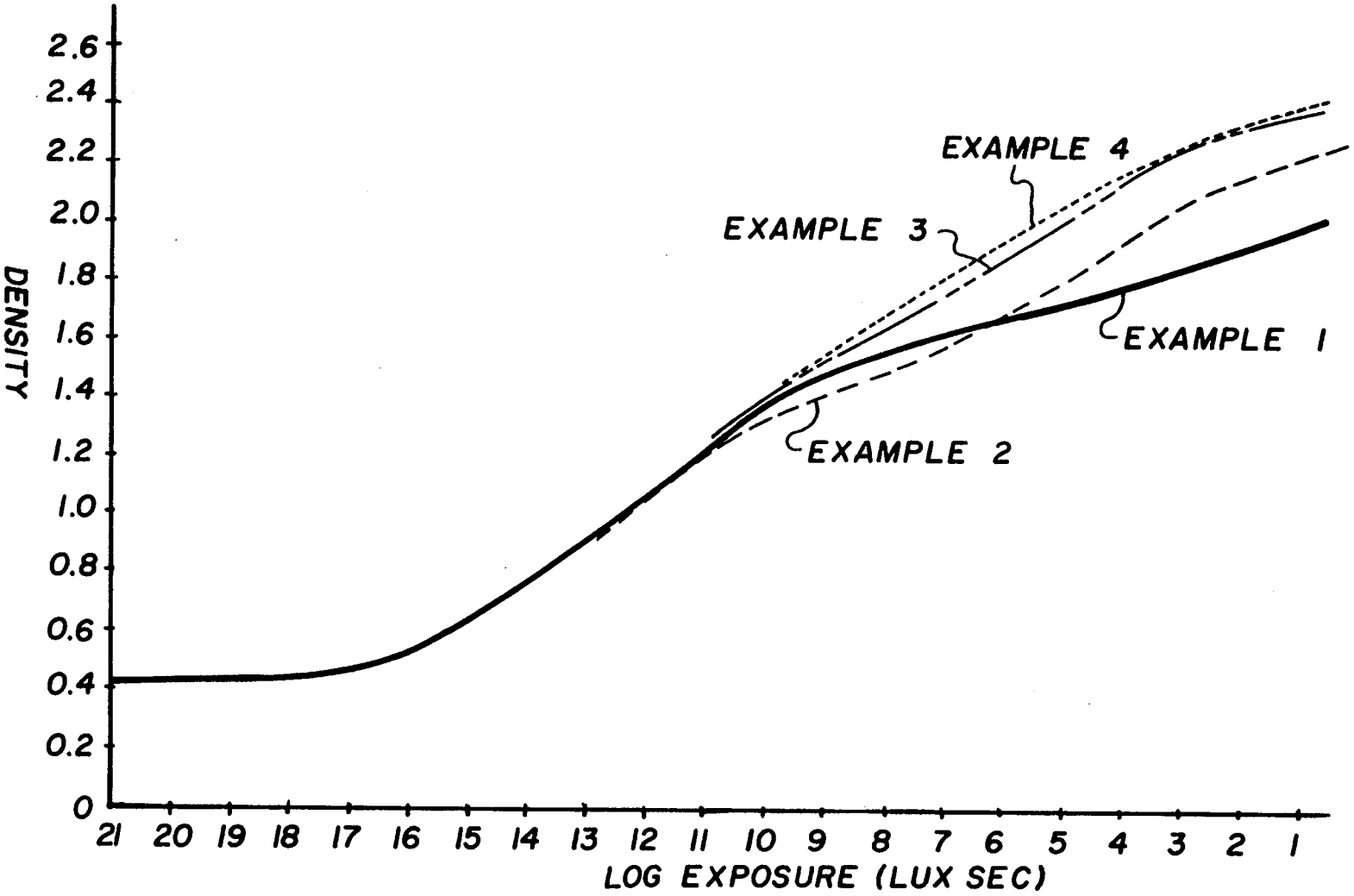
FIG. 2 contains actually produced characteristic profiles—that is, plots of optical density versus exposure (E) in lux-seconds. The units of from 1 to 21 represent successive steps of a step tablet in which the exposure difference between adjacent steps in 0.2 log E.

The magenta image dye characteristic profile of Example 1 is shown for purposes of comparison in each of FIG. 2.

Example 2 (Example)

A second control multicolor photographic element was constructed as described above with the following emulsion selections for the magenta dye image forming green recording layer unit:

| | |
|---|---|
| F-EmL | FM-1 |
| M-EmL | MM-1 |
| S-EmL | SM-2 |

By referring back to Table I it can be seen that the purpose of selecting this control for comparison was to demonstrate the performance of a dye image forming layer unit containing three tabular grain silver bromoiodide emulsion layers differing in speed employing uniform iodide in each of the emulsion layers, with the level of iodide being relatively restricted in only the slowest of the emulsion layers.

By comparison with Example 1 in FIG. 2 it is apparent that restricting the iodide level of S-EmL relative to that of M-EmL significantly improved the shape of the characteristic curve.

Example 3 (Example)

A third multicolor photographic element was constructed to satisfy the requirements of the invention with the following emulsion selections for the magenta dye image forming green recording layer unit:

| | |
|---|---|
| F-EmL | FM-1 |
| M-EmL | MM-2 |
| S-EmL | SM-2 |

By referring back to Table I it can be seen that the purpose of selecting this control for comparison was to demonstrate the performance of a dye image forming layer unit containing three silver bromoiodide tabular grain emulsion layers differing in speed with uniform iodide distribution, wherein the highest iodide level was placed in the fastest emulsion layer, the lowest iodide level was placed in the slowest emulsion layer, and an intermediate iodide level was placed in the emulsion layer of intermediate speed.

The magenta image dye characteristic profile of Example 3 is shown for purposes of comparison in FIG. 2. Example 3 produced a characteristic profile having a marked advantage over that of each of control Example 1 and Example 2. The shoulder density profile was very nearly ideal.

Example 4

A fourth multicolor photographic element was constructed to satisfy the requirements of the invention with the following emulsion selections for the magenta dye image forming green recording layer unit:

| | |
|---|---|
| F-EmL | FM-1 |
| M-EmL | MM-2 |
| S-EmL | SM-3 |

By referring back to Table I it can be seen that the purpose of selecting this control for comparison was to demonstrate the performance of a dye image forming layer unit containing three silver bromoiodide tabular grain emulsion layers differing in speed with uniform iodide distribution, wherein the highest iodide level was placed in the fastest emulsion layer, the lowest iodide level was placed in the slowest emulsion layer, and an intermediate iodide level was placed in the emulsion layer of intermediate speed.

The magenta image dye characteristic profile of Example 4 is shown for purposes of comparison in FIG. 2. Example 4 produced a characteristic profile having a marked advantage over both control Example 1 and Example 2. Example 4 also demonstrated a significant advantage over Example 3 in the mid-scale to shoulder exposure range.

Granularity comparisons of Examples 1 to 4 inclusive revealed similar, acceptable granularity characteristics.

The invention has been described in detail with particular reference to preferred embodiments thereof, but it will be understood that variations and modifications can be effected within the spirit and scope of the invention.

What is claimed is:

1. A multicolor photographic element capable of satisfying a selected characteristic profile with reduced granularity comprised of a support and at least three dye image forming layer units each containing an image dye or dye precursor capable of forming a dye image of a different hue, CHARACTERIZED IN THAT at least one of the dye image forming layer units capable of forming a visible dye image contains at least three superimposed radiation sensitive emulsion layers in which a first emulsion layer located farthest from the support of the three emulsion layers contains silver bromoiodide grains of from 1 to 20 mole percent iodide, based on silver, second emulsion layer at least one half stop slower in speed than the first emulsion layer is located between the first emulsion layer and the support and silver bromoiodide tabular grains of the second emulsion have an average iodide content that is up to 60 percent the average iodide content of the first emulsion layer, and a third emulsion layer at least one half stop slower in speed than the second emulsion layer is located between the second emulsion layer and the support and contains silver bromoiodide grains having an average iodide content that is up to 60 percent the average iodide content of the second emulsion layer, greater than 50 percent of the total projected area of the grains of each of the first, second and third emulsion layers being accounted for by tabular grains having a thickness of less than 0.3 μm and average tabularity of greater than 25, tabularity (T) being defined as $$T=ECD/t^2$$

where

ECD is the average equivalent circular diameter of the tabular grains in μm and t is the average thickness in μm of the tabular grains, and tabular grains of at least the first and second emulsion layers when exposed to 325 nm electromagnetic radiation at 6° K. exhibiting a stimulated fluorescent emission at 575 nm that is less than one third the intensity of an identically stimulated fluorescent emission maximum within the wavelength range of from 490 to 560 nm.

2. A multicolor photographic element according to claim 1 further characterized in that the tabular grains account for greater than 70 percent of total grain projected area.

3. A multicolor photographic element according to claim 1 further characterized in that the stimulated fluorescent emission at 575 nm of the tabular grains of each of the first and second emulsion layers is less than 25 percent the peak stimulated emission maximum within the wavelength range of from 490 to 560 nm.

4. A multicolor photographic element according to claim 3 further characterized in that the first emulsion layer contains at least 3 mole percent iodide, based on silver.

5. A multicolor photographic element according to claim 1 further characterized in that each of the first emulsion layer contains at least 3 mole percent iodide, based on silver.

6. A multicolor photographic element according to claim 1 further characterized in that the tabular grains of the third emulsion layer contain an average iodide content that is at least 40 percent of the average iodide content of the tabular grains of the second emulsion layer.

7. A multicolor photographic element according to claim 1 further characterized in that second emulsion layer is from one to two stops slower than the first emulsion layer.

8. A multicolor photographic element according to claim 1 further characterized in that the third emulsion is from one to three stops slower than the second emulsion layer.

9. A multicolor photographic element according to claim 1 further characterized in that at least one of the dye image forming layer units containing the first, second and third emulsion layers exhibits a variance in contrast of less than 10 percent over an exposure range of seven stops.

10. A multicolor photographic element according to claim 1 capable of satisfying a selected characteristic profile with reduced granularity in which the at least three dye image forming layer units are comprised of a yellow dye image forming blue recording layer unit, a magenta dye image forming green recording layer unit, and a cyan dye image forming red recording layer unit, further characterized in that at least one of the magenta dye image forming green recording layer unit and the cyan dye image forming red recording layer unit contains said at least three superimposed emulsion layers, in which said first emulsion layer located farthest from the support of the three emulsion layers contains silver bromoiodide grains of from 3 to 20 mole percent iodide, based on silver, said second emulsion layer from one to two stops slower in speed than the first emulsion layer is located between the first emulsion layer and contains silver bromoiodide grains having an average iodide content of from 40 to 60 percent the average iodide content of the first emulsion layer, and said third emulsion layer from one to three stops slower in speed than the second emulsion layer is located between the second emulsion layer and the support and contains silver bromoiodide grains having an average iodide content of from 40 to 60 percent the average iodide content of the second emulsion layer, greater than 70 percent of the total projected area of the grains of each of the first, second and third emulsion layers being accounted for by tabular grains having a thickness of less than 0.3 μm and average tabularity of greater than 25, tabularity (T) being defined as $$T = ECD/t^2$$

where

ECD is the average equivalent circular diameter of the tabular grains in μm and t is the average thickness in μm of the tabular grains, and tabular grains of the emulsion layers being capable of producing, when exposed to 325 nm electromagnetic radiation at 6° K., a stimulated fluorescent emission at 575 nm that is less than 25 percent the intensity of an identically stimulated fluorescent emission maximum within the wavelength range of from 490 to 560 nm.

11. A multicolor photographic element according to claim 10 further characterized in that at least one of the dye image forming layer units containing the first, second and third emulsion layers exhibits a variance in contrast of less than 10 percent over an exposure range of seven stops.

12. A multicolor photographic element according to claim 11 further characterized in that over the exposure range of seven stops the variance in contrast is less than 5 percent.

* * * * *